US006202877B1

(12) United States Patent
La Torre et al.

(10) Patent No.: US 6,202,877 B1
(45) Date of Patent: Mar. 20, 2001

(54) LIP-OPENABLE SPILL-PROOF CONTAINER

(75) Inventors: Richard D. La Torre, Oakland, NJ (US); Joseph P. Sejnowski, North Kingston; Aidan J. Petrie, Providence, both of RI (US)

(73) Assignee: Playtex Products, Inc., Westport, CT (US)

( * ) Notice: Subject to any disclaimer, the term of this patent is extended or adjusted under 35 U.S.C. 154(b) by 0 days.

(21) Appl. No.: 09/421,799

(22) Filed: Oct. 20, 1999

Related U.S. Application Data

(60) Provisional application No. 60/104,897, filed on Oct. 20, 1998, and provisional application No. 60/148,095, filed on Aug. 10, 1999.

(51) Int. Cl.[7] ..... A47G 19/22

(52) U.S. Cl. ..... 220/254; 220/703; 220/714; 222/517

(58) Field of Search ..... 220/254, 255, 220/703, 711, 713, 714, 716, 718, 719, 281, 283, 288; 215/311, 315; 222/517

(56) References Cited

U.S. PATENT DOCUMENTS

| | | | |
|---|---|---|---|
| D. 365,247 | 12/1995 | Sokolski et al. . | |
| 3,015,411 | 1/1962 | Smith . | |
| 3,208,629 | 9/1965 | Beeson . | |
| 3,338,467 | 8/1967 | Albert . | |
| 3,797,696 | 3/1974 | Dibrell . | |
| 4,113,135 | 9/1978 | Yamazaki . | |
| 4,138,033 | 2/1979 | Payne et al. . | |
| 4,165,013 | 8/1979 | Lutz . | |
| 4,184,603 | 1/1980 | Hamilton, Sr. . | |
| 4,184,604 | 1/1980 | Amberg et al. . | |
| 4,238,045 | 12/1980 | D'Andria . | |
| 4,245,752 | 1/1981 | Prueher . | |
| 4,412,629 | 11/1983 | Dart et al. . | |
| 4,441,623 | 4/1984 | Antoniak . | |
| 5,082,134 | 1/1992 | Ramsey . | |
| 5,150,816 | 9/1992 | DeCastro . | |
| 5,186,353 | 2/1993 | Ramsey . | |
| 5,222,623 | 6/1993 | Eger et al. . | |
| 5,295,597 | 3/1994 | Green . | |
| 5,485,938 * | 1/1996 | Boersma | 220/714 |
| 5,490,622 | 2/1996 | Tardif . | |
| 5,540,350 | 7/1996 | Lansky . | |
| 5,706,972 | 1/1998 | Sousa . | |
| 5,762,228 | 6/1998 | Morgan et al. . | |
| 6,062,419 * | 5/2000 | Kruger et al. | 220/711 |

OTHER PUBLICATIONS

"GLS Technical Data Sheet Versaflex CL2042X Thermoplastic Elastomer Alloy", (undated), 1 page.

"GLS Technical Data Sheet Processing Versaflex CL2042X Alloy" (showing a Table (heading illegible) of processing conditions and a Chart of Melt Viscosity vs. Shear Rate), (undated), 1 page.

(List continued on next page.)

*Primary Examiner*—Nathan J. Newhouse
(74) *Attorney, Agent, or Firm*—Ohlandt, Greeley, Ruggerio & Perle, L.L.P.

(57) ABSTRACT

A lip-openable lid is provided for use in connection with a container or container cap having a valve seat and an opening for egress of container contents. A lip-openable container is also provided that employs the lip-openable lid. The lid is comprised of a gasket with a lip-engageable annular wall, a central portion radially inward of the wall, and a peripheral flange that is engageable with the valve seat. The lid includes a rigid support that has liquid flow openings, supports the central portion of the gasket and positions the gasket against the valve seat. The lid can also include means for securing the gasket to the support. The central portion of the gasket is comprised of a flexible elastomer and is capable of flexing and stretching to displace the flange from the valve seat when downward pressure is applied against the gasket. When downward pressure is applied, the central portion of the gasket contacts the rigid support and flexes and stretches downward from and/or over the rigid support.

30 Claims, 16 Drawing Sheets

OTHER PUBLICATIONS

"GLS Technical Data Sheet Vesaflex CL2050X Thermoplastic Elastomer Alloy" (showing a Table (heading illegible) of physical properties and a Stress Strain Curve), (undated), 1 page.

"GLS Technical Data Sheet Processing Versaflex CL2050X TPE Alloy" (showing a Table (heading illegible) of processing conditions, and a Chart of Melt Viscosity vs. Shear Rate), (undated), 1 page.

"GLS Corporation Technical Data Sheet" Dynaflex G2711 Thermoplastic Rubber Compound, Contains KRATON G Polymer, (showing a Table titled "Typical Physical Properties" and showing Stress vs. Strain for Dynaflex G2711 Rubber), (undated), 1. page.

"GLS Corporation Dynaflex G2711 Thermoplastic Rubber Compound, Contains KRATON G Polymer, Processing" (showing a Table titled "Suggested Processing Conditions" and a Chart of Melt Viscosity vs. Shear Rate for Dynaflex G2711 Rubber), (undated), 1 page.

"GLS Technical Data Sheet Vesaflex GL2050X Thermoplastic Elastomer Alloy" (showing a Table (heading illegible) of physical properties and a Stress Strain Curve), (undated), 1 page, with handwritten notation.

"GLS Corporation" Vesaflex CL2050X, Processing, (showing a table (heading illegible) of temperatures and a chart of Melt Viscosity vs. Shear Rate), (undated), 1 page, with handwritten notation.

Publication Titled "Introduction Kraton ® Polymers" that discusses "Block Copolymer Structures", "Kraton ® D Polymer series" and "Kraton G Polymer series" (undated), 2 pages.

* cited by examiner

FIG. 3
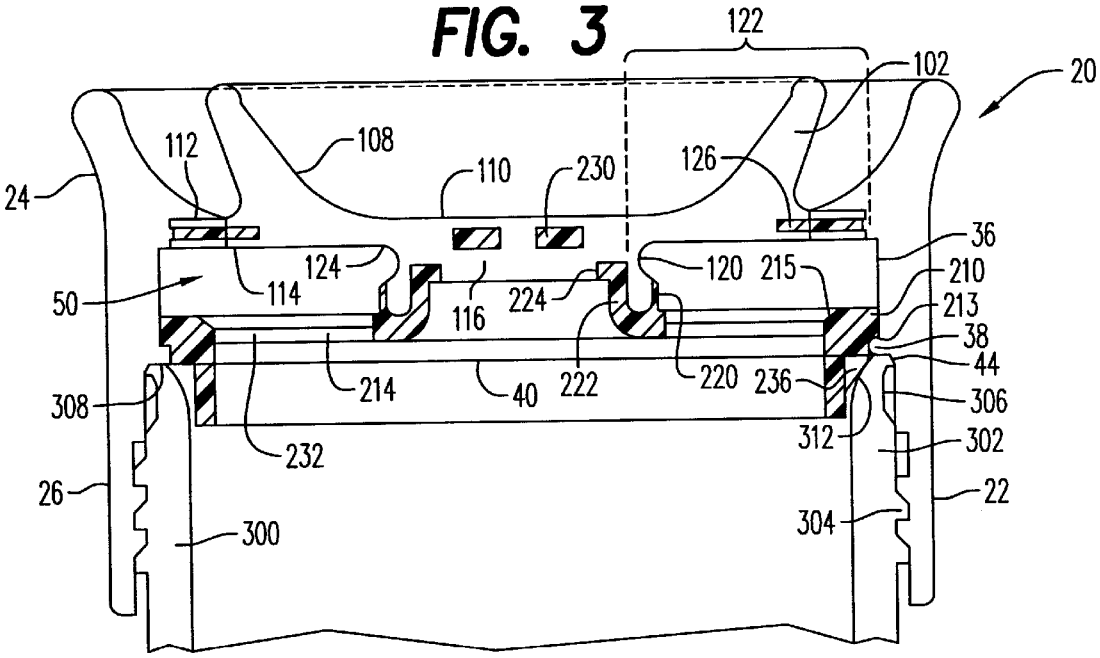
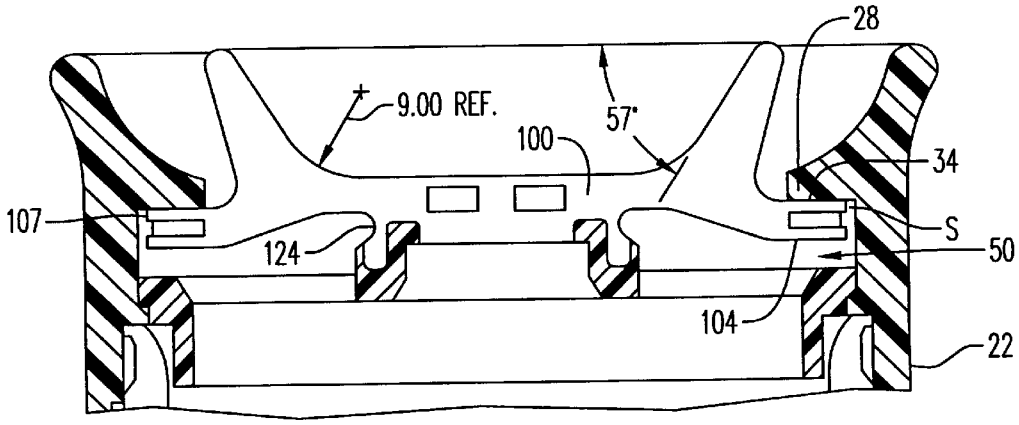
FIG. 3A
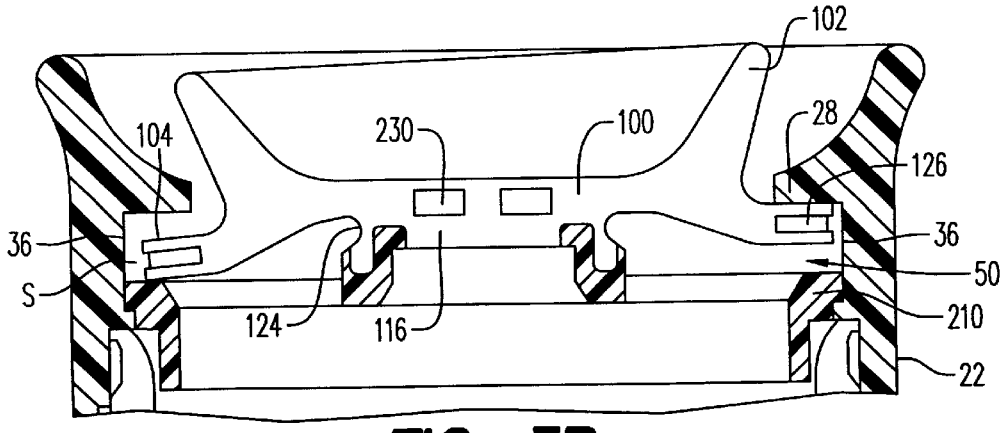
FIG. 3B

FIG. 4
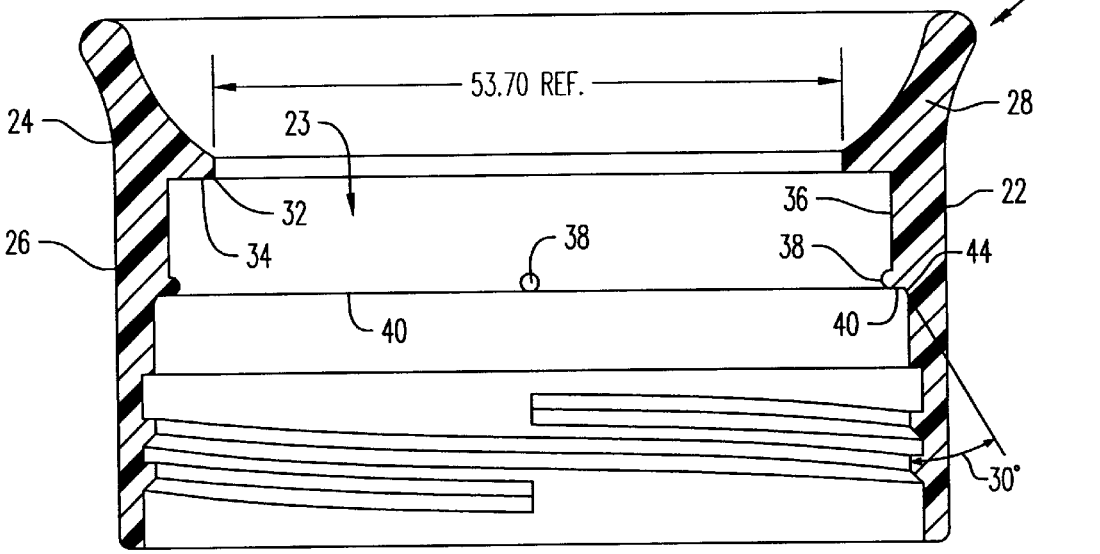
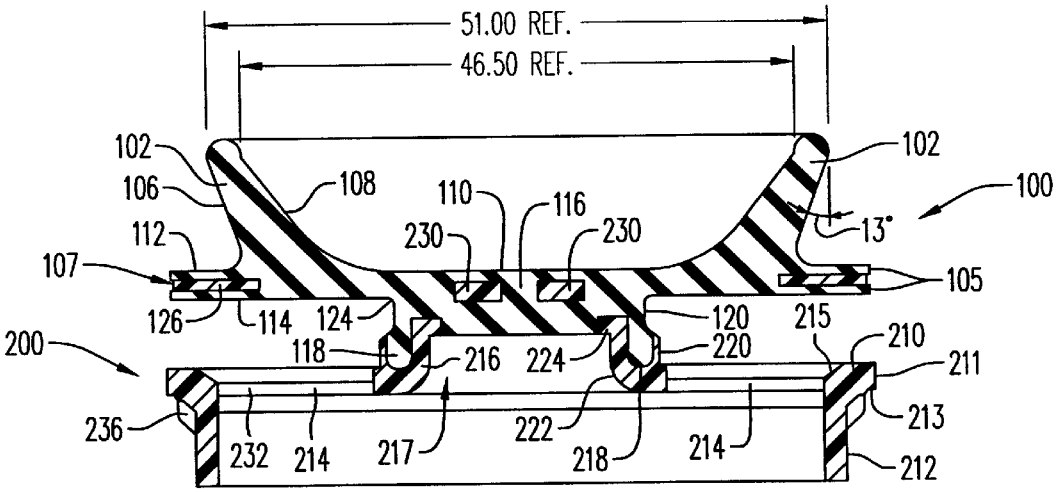
FIG. 5
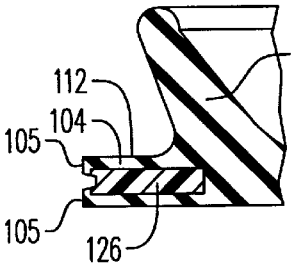
FIG. 5A
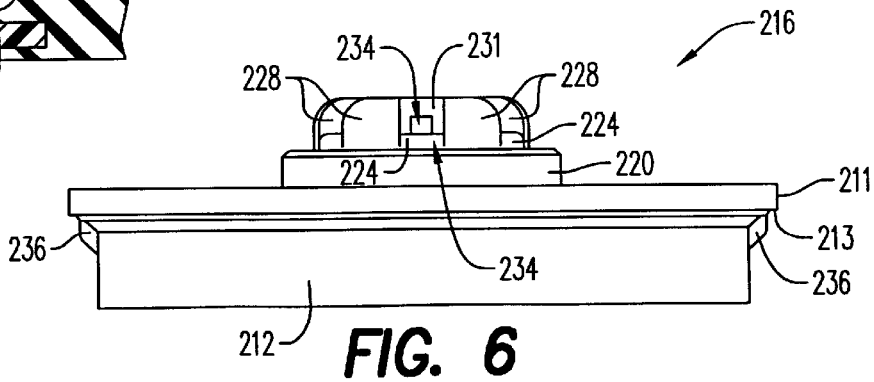
FIG. 6

LIP-OPENABLE SPILL-PROOF CONTAINER

This application claims the benefit of and incorporates by reference U.S. Provisional Application No. 60/104,897, filed Oct. 20, 1998 and U.S. Provisional Application No. 60/148,095, filed Aug. 10, 1999.

BACKGROUND OF THE INVENTION

Field of the Invention

The present invention relates to drinking containers for liquids. More particularly, the present invention is directed to drinking containers and lids for drinking containers that are openable by the user's lips.

Lip-openable containers are known. Such containers are desirable for children in their progression from use of a container whose lid has a spout, to an adult open-ended drinking container. Lip-openable containers are desirable because, as compared to containers with a spout, they do not require orientation of the cup to bring a spout to the children's lips, and they help children learn the sipping action needed for use of an open-ended container, such as a glass. Also, lip-openable containers are highly convenient since only one hand is required to drink from the container, and when drinking is completed the container closes automatically.

Heretofore, lip-openable containers have employed a movable lid seated within a central opening of the container closure cap. The lid functions as a valve. In its normal position, the lid is urged or biased upward by an underlying spring device, so that the periphery of the lid seats against an overlying, surrounding valve seat that is part of the closure cap. To drink from the container, a person uses his or her upper lip to push downward on a portion of the periphery of the lid, against the bias of the spring, to create an opening between the lid and the valve seal that allows liquid to flow therethrough.

Heretofore, the movable lid has been constructed of a rigid material. The application of lip pressure to the rigid lid, for example, at about 9 o'clock on its circumference, would depress the lid from a pivot point seeking a location at about 3 o'clock, i.e., about 180° opposite from where the pressure is applied. This is disadvantageous because with downward pressure of a user's lip that is necessarily exerted in a relatively localized area, a portion of the rigid lid substantially wider than the localized area of pressure, e.g., a segment of an arc approaching 180° or more of the periphery of a circular lid, is removed from the valve seat. This causes spillage at the sides of the user's lips. Also, a rigid lid does not have a natural feel and is uncomfortable to the user's lips.

It would be desirable to have an improved lip-openable container that does not require a spring device. It would also be desirable to have a lip-openable container that does not employ a rigid lid, and that when open, allows liquid flow into the user's mouth and not outside or beyond it. It would thus be desirable to have a non-rigid lid that avoids spillage of liquid from an excessively wide opening, as is created between a rigid lid and its surrounding valve seat when a user applies localized lip pressure to the rigid lid.

SUMMARY OF THE INVENTION

It is an object of the present invention to provide such an improved lip-openable container that does not require a spring member to bias the lid against a valve seat.

It is another object of the present invention to provide such an improved lip-openable container whose movable lid is a non-rigid, flexible material.

It is another object of this invention to provide an improved flexible lid that is a flexible material that stretches and recovers to move the lid away from and into contact with a valve seat.

It is still another object of the present invention to provide an improved flexible lid that is spill-proof.

It is a further object of the present invention to provide such an improved flexible lid that does not leak.

It is still a further object of the present invention to provide such a flexible lid that is adapted to bend or flex in response to the application of localized lip pressure on the lid and create a localized graduated opening in the container in the area of applied lip pressure.

It is yet a further object of the present invention to provide such a flexible lid that localizes flow of liquid into the user's mouth and not outside or beyond the user's mouth.

It is yet another object of the present invention to provide such a flexible lid that is made of a soft material that has a comfortable, natural feel to the user's lips.

It is yet another object of the present invention to provide such a flexible lid that is easy to use, even for young children.

It is yet another object of the present invention to provide such a flexible lid that is advantageous for young children in that in use it can provide a metered flow of liquid and prevent the child from receiving an excessive amount of liquid at one time.

These and other objects of the present invention will be achieved by a container closed by a lid having a lip-openable flexible gasket with a portion, preferably a peripheral portion thereof, in tension and releasably seated against an overlying valve seat. Upon the application of lip pressure to the gasket, the gasket bends or flexes and/or stretches in, from, adjacent and/or about the area of applied pressure, to remove the flexed or bent area from the valve seat and create an opening that allows liquid container contents to flow through the opening into the user's mouth. Upon the release of the lip pressure on the gasket, the flexed or bent or stretched area automatically returns and seats against the valve seat.

Thus, the present invention is directed to a lid for use in connection with a container or container cap having an inwardly extending ledge that forms a valve seat and defines an opening for egress of container contents therethrough.

The present invention is also directed to a lip-openable container comprising a container body, a removable cap having a ledge that forms a valve seat and defines a central opening, and a removable lip-openable lid.

The lid is a gasket having a central panel having a flexible elastomer and a flange that is engageable with the valve seat. The lid includes a support that supports the central panel of the gasket and is capable of positioning the gasket against the valve seat of the cap. The lid can also include means for securing the central panel, preferably a central portion thereof, to a central section of the support. The central portion of the gasket is capable of flexing and stretching to allow a portion of the flange to be displaced from the valve seat when downward pressure is applied against a portion of the gasket. The gasket preferably has an upstanding lip-engageable wall that can be rigid or flexible and preferably is annular.

The support preferably is rigid, has a base, and has a central section connected to the base. When downward pressure is applied against the gasket, the central panel of the gasket can contact the rigid support, preferably a central section thereof, e.g. a rigid bearing surface, such that a portion of the central panel of the gasket flexes downward from or about, or stretches downward from, or stretches over the rigid support, to displace the flange of the gasket from the valve seat.

The securing means of the lid can comprise a flexible elastomer and can be part of the gasket, preferably part of its central portion, part of the support, preferably part of its central section, or part of the gasket and the support. The securing means of the gasket can be a flexible member, e. g., a trunk, that is integral with and depends from the central panel, preferably a central portion thereof, and that includes retaining means for engaging structure of the support. The trunk can have a dead end bore extending upward into it, and the lid can include a rigid plug having a stem seated in the bore to compress the trunk against the central section of the support and improve the engagement of the retaining means of the gasket to the support.

The securing means of the support can include structure, e.g., engaging means, of the central section of the support, for engaging structure, e.g., retaining means, of the gasket. The securing means of the central section of the support can include a rigid hub with engaging means that engage the retaining means of the trunk of the gasket to flexibly secure the gasket to the support. The hub can include an annular bearing surface that engages a concavely curved surface of the trunk and facilitates flexing of the central panel of the gasket downward and radially outward of the annular bearing surface. The bearing surface can be positioned under the central panel, preferably under the central portion thereof.

The securing means of the support can include upstanding rigid structure with openings therethrough and the securing means of the gasket can include portions of the central portions of the gasket that extend through the openings and engage the rigid structure.

The rigid wall of the gasket can have a lower portion with a radially inwardly extending lip to which the flexible elastomer of the central portion of the gasket is attached, and a radially outwardly extending lip whose upper surface has a layer of an elastomer with an upstanding peripheral annular sealing bead thereon.

BRIEF DESCRIPTION OF THE DRAWINGS

FIG. 3 is a vertical sectional view, with portions broken away, of the container of FIG. 1;

FIG. 3A is a vertical sectional view, as in FIG. 3, showing the gasket of lid 50 in the closed position;

FIG. 3B is a vertical sectional view, as in FIG. 3, showing the gasket of lid 50 in the open position;

FIG. 4 is a vertical sectional view of the cap ring shown in FIG. 3;

FIG. 5 is a vertical sectional view taken along line 5—5 of the gasket assembly shown in FIG. 2;

FIG. 5A is an enlarged sectional view with portions broken away of the top left portion of the gasket of FIG. 5;

FIG. 6 is a side elevational view of the gasket support, broken away from the gasket assembly shown in FIG. 2, as would be seen along line 6—6 of FIG. 7;

DETAILED DESCRIPTION OF THE INVENTION

Figure 1:
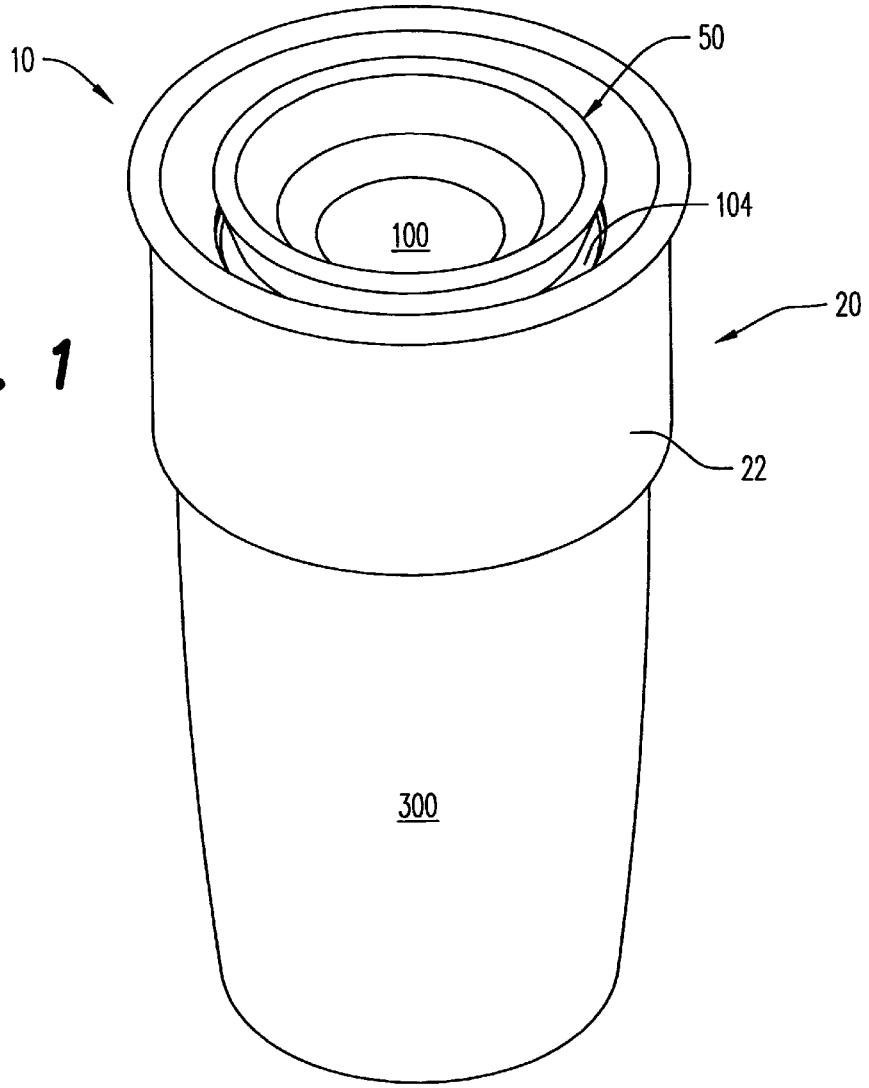
FIG. 1 is a top perspective view of the container assembly of the present invention.
Figure 1A:
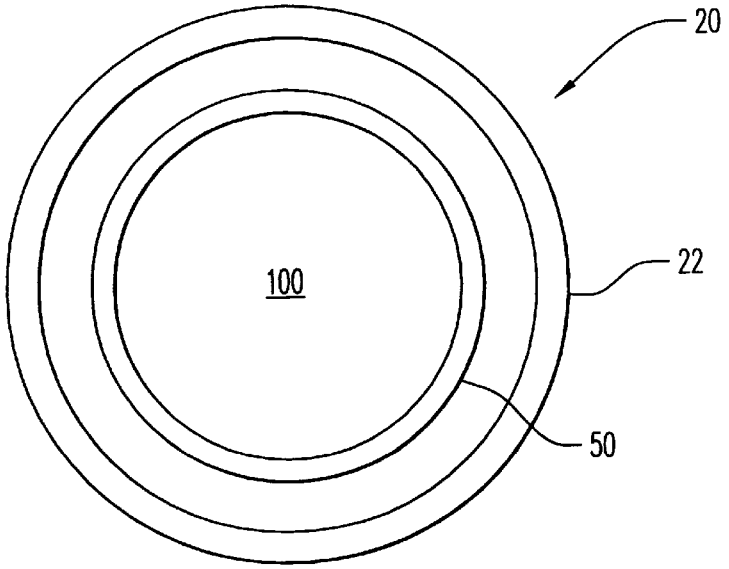
FIG. 1A is a top plan view of the container of FIG. 1.
Figure 2:
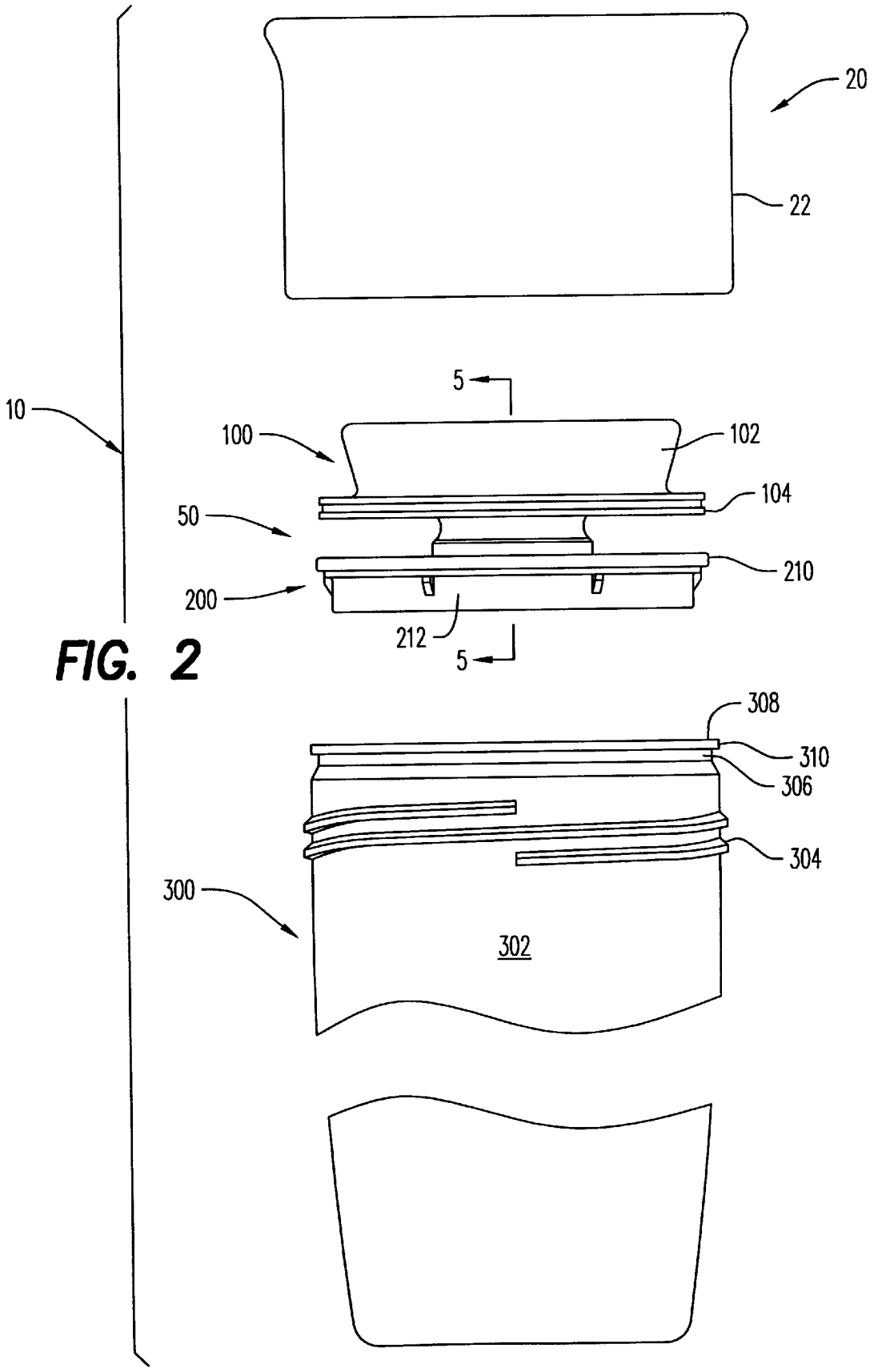
FIG. 2 is an exploded side elevational view, with portions broken away, of the main components of the container of FIG. 1.

Referring to the drawings and, in particular, in FIG. 1, there is shown a preferred embodiment of the container of the present invention generally represented by the reference numeral 10. Container 10 has a closure 20 and a container body 300. As shown in. FIGS. 1A and 2, closure 20 has a cap ring 22 and, mounted to it, a lid 50. Lid 50 is a gasket assembly having a movable gasket 100 and a gasket support 200.

Gasket 100 functions as a valve. It is made of a flexible elastomeric material, and has an annular upwardly extending outwardly-flared conical wall 102. About the base of wall 102, there is an annular radially outwardly extending, peripheral flange 104. Gasket support 200 is made of a rigid material and has an annular peripheral ring portion 210 and an annular depending skirt 212. Container body 300 has a body wall 302 whose upper end portion includes a helical thread 304, a radially inwardly recessed wall 306, and a rim 308 having a peripheral side edge 310.

As shown in FIG. 4, cap ring 22 is a cylindrical structure having an outwardly flared, conically shaped upper wall 24 and a depending skirt 26. The outside surface of the upper portion of the wall 24 is concavely curved for receiving a user's lower lip. The inside surface of wall 24 is also concavely curved and communicates with a radially inwardly extending ledge 28 having a lower corner 32 and an inner edge 30, and an outwardly extending lower surface 34. Corner 32 and/or, at times, substantially all or a portion of lower surface 34 functions as a valve seat for flange 104 of gasket 100. Lower surface 34 communicates with a cylindrical wall 36 having an radially inwardly protruding member or members, here shown as four equally circumferentially spaced snap lugs 38, for mounting lid 50 onto cap ring 22.

FIGS. 3 through 3B show lid 50 assembled to cap ring 22 to form closure 20 that is secured to container body 300. To assemble closure 20, lid 50 is pushed upwardly into cap ring 22. Gasket support ring 210 is snapped into place on snap lugs 38 which support and maintain gasket support 200 and lid centrally located and in horizontal disposition within cap ring 22. The lower surfaces of snap lugs 38 are coplanar and merge with a radially outwardly extending horizontal surface that forms a ridge 40 on which cap ring 22 rests on rim 308 of container body 300. Ridge 40 merges with a cylindrical wall 42 through a downwardly and outwardly angled sealing surface 44, that is engaged by rim 308 and side edge 310 to form a hermetic seal between cap ring 22 and container body 300. As shown in FIG. 3, the upper end of the inside surface of container body wall 302 merges into a rim 308 through a concavely curved surface 312. The outer surface of body wall 302 can have an annular area, and recessed panel 306 for mounting an annular sealing ring therein and thereon (not shown) to assist, if necessary, in providing a hermetic seal between cap ring 22 and container body 300.

Figure 7:
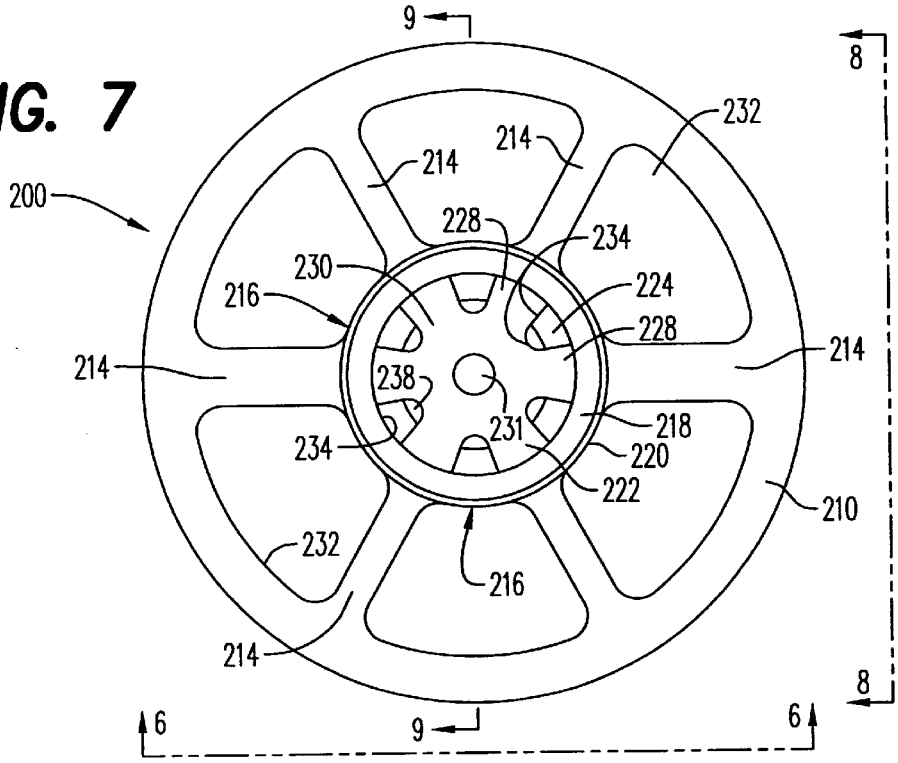
FIG. 7 is a top plan view of the gasket support shown in FIG. 6.

FIG. 3 and FIG. 5, 5A and 7, show that gasket support 200 of lid 50 includes an annular ring 210, a depending skirt 212, radially spokes 214 and structure for securing gasket 100 to gasket support 200. Such structure is shown as including central, annular hub 216 extending upwardly from ring spokes 214. Hub 216 has a lower portion 217 that includes an annular U-shaped channel 218 formed by a radially outer wall 220 and a taller, radially inner wall 222 having a radially inwardly extending annular rim 224. Hub 216 has an upwardly extending upper portion 226 (FIG. 8) having upper spokes 228 extending from a central web 230 with a central hole 231 (FIG. 7). Spokes 214 of ring 210, hub 216, and annular ring 210 between them define openings 232 for flow of liquid therethrough. Between upper spokes 228 of hub upper portion 226 are openings 234. Web 230 has a hole 231 therein for the flow of gasket material therethrough and into bore 217 of hub 216 during overmolding of gasket 100 onto gasket support 200. Ring 210 of gasket support 200 has a radially outwardly extending peripheral edge 211 with an undersurface 213 on which gasket support 200 rests on snap lugs 38 of cap ring 22. Gasket support 200 also has structure, here shown as circumferentially spaced support ribs 236, for radially supporting and thereby centrally and horizontally positioning gasket support 200 in cap ring 22. As shown in FIG. 3, support ribs 236 engage curved surface 312 adjacent rim 308 of container body wall 300.

FIGS. 3, 5, 5A and 7 show gasket 100 of lid 50 overmolded onto and positively secured to gasket support 200. As shown in FIG. 7, during the overmolding process, gasket material flows into upper openings 238 and hole 231 in upper hub portion 226, and into annular U-shaped channel 218 of hub 216. Accordingly, gasket 100 is preferably made integral or unitary with gasket support 200.

As shown in FIGS. 3, 5, and 5A, conical wall 102 of gasket 100 preferably has a downwardly and inwardly angled outer surface 106 and a more gradually downwardly and inwardly angled inner surface 108 that merges through a radius of curvature into a recessed central panel 110. Panel 110 need not be, but preferably is, in the same plane as upper surface 112 of flange 104. Gasket 100 has an annular peripheral undersurface 114 that merges with depending cylindrical central trunk or base 116, for securing gasket 100 to gasket support 200. Base 116 includes a depending annular retaining ring 118 positioned and held in U-shaped channel 218 of gasket support 200. The upper portion of base 116 preferably is undercut with a concavely curved, reduced diameter portion 120 that merges with undersurface 114. Concave portion 120 facilitates bending or flexing of outer peripheral portion 122 at or adjacent junction 124 when a user of the container applies downward and radially outward lip pressure to inner surface 108 of conical wall 102. Flange 104 of gasket 100 need not have, but preferably includes structure, here shown as a rigid annular ring 126 of a material for rigidifying flange 104. Annular ring 126 can be secured to or radially inwardly contained in flange 104 in any suitable manner, for example, here shown by opposed upper and lower peripheral edge 105.

FIG. 3A shows annular flange 104 in tension and urged or biased and seated against and along most of lower surface 34 of ledge 28. This creates the hermetic seal between gasket 100 and cap ring 22. FIG. 3A shows a gap or space S between the outer side edge 107 of flange 104 and wall 36 of the cap ring. As will be explained, this space S allows liquid to flow therethrough. FIG. 3A also shows the inner diameter dimension of ledge 28 and the outer diameter of flange 104.

Figure 14:
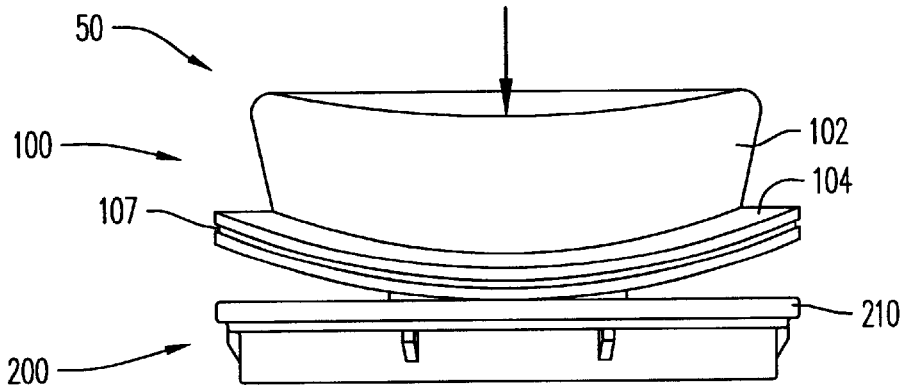
FIG. 14 is a side elevational view of the lid of the present invention showing pressure applied to the lid.
Figure 15:
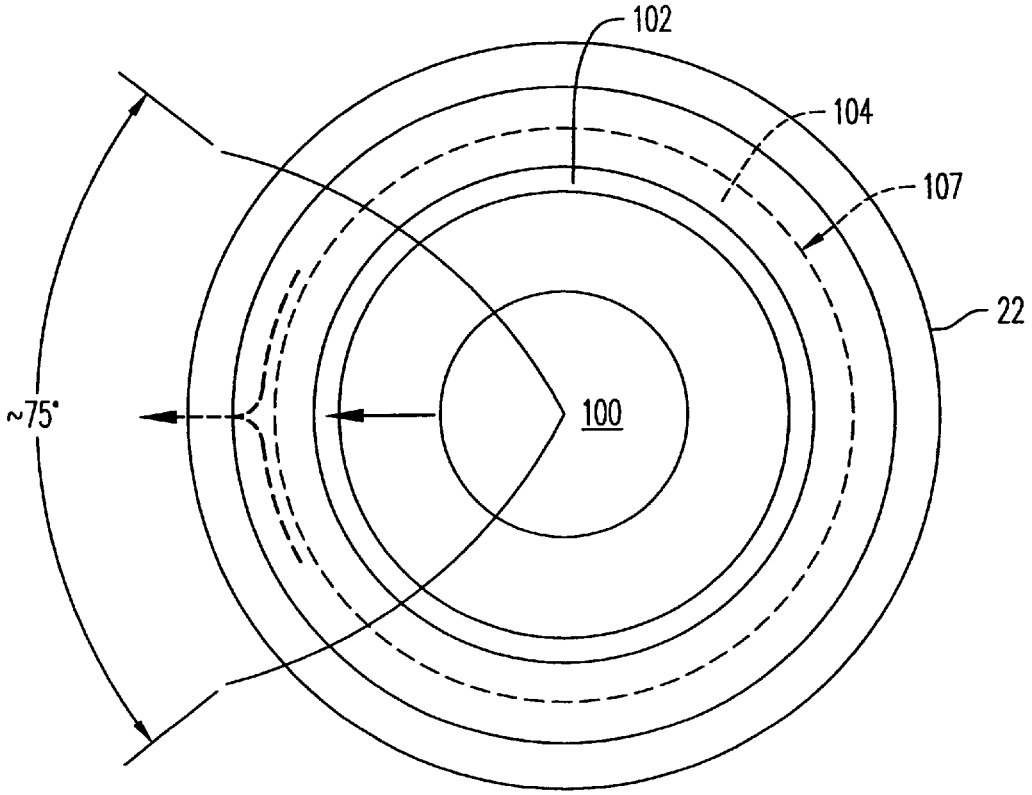
FIG. 15 is a top view of the lid of the present invention showing pressure applied to a lid.

FIG. 3B shows a left side portion of gasket 100 bent or flexed downwardly by the application of pressure of a user's upper lip on the inner surface 108 of conical wall 102. As shown, the pressure moves flange 104 away from ledge 28 and creates passageway for flow of liquid therethrough. The bending or flexing of gasket 100 occurs at or about a central portion of the gasket, adjacent or at the junction 124 of undersurface and base 116 of gasket 100, and along and through the portion of gasket 100 radially outward of junction 124. Unexpectedly, the application of lip pressure against the underlying area of the gasket usually does not move flange 104 to an interstitial position between ring 210 such that liquid flows under flange 104. Rather, as shown in FIGS. 3A and 14, it has been found that flange 104 usually or always engages ring 210 under the area where the pressure is applied such that little or no liquid flows between the engaging surfaces. It has been found that, given the flexibility of gasket, and that, as shown in FIG. 14, portions of the flange 104 circumferentially to either side of the area of engagement are spaced from ring 210, liquid flows out of the open areas to either side of the engaging surfaces. As shown in FIG. 15, some liquid passes circumferentially along and about outer peripheral edge 107 of flange 104 in the spaces between edge 107 and wall 36 of ring cap 22 in the area where the flange engages ring 210, and that liquid passes into the user's mouth. Thus, despite the engaging surfaces, the flow is into the user's mouth as if the liquid had passed directly radially outward from a gap between the portion of the flange where the pressure was applied, and an underlying portion of ring 210.

FIGS. 6 through 10 show different views of a preferred embodiment of gasket support 200 and particularly its hub 216 onto which base 116 of gasket 100 is overmolded and secured. FIG. 6 shows the upper portion of hub 216, including upper spokes 228 and portions of rim 224 that are visible through upper openings 234 between spokes 228.

FIG. 7 shows the wagon-wheel appearance of gasket support 200. Annular ring 210 of gasket support 200 is joined to central hub 216 by radial spokes 214. These structures define openings 232 between them and through gasket support 200. Hub 216 includes about its periphery outer and inner walls 220, 222, respectively, that define U-shaped channel 218. Extending radially inward from inner wall 222 is annular rim 224 that underlies and shows through openings 234 between spokes 228. Hub 216 has a central web 230 with a central hole 231. Spokes 228 extend radially outward from web 230 and turn downward and merge into inner wall 222. Web 230, spokes 228 and inner wall 222 define conically shaped openings 234. Under and visible near the tip of each opening 234 is a passageway 238 that communicates with bore 217 of hub 216.

Figure 8:
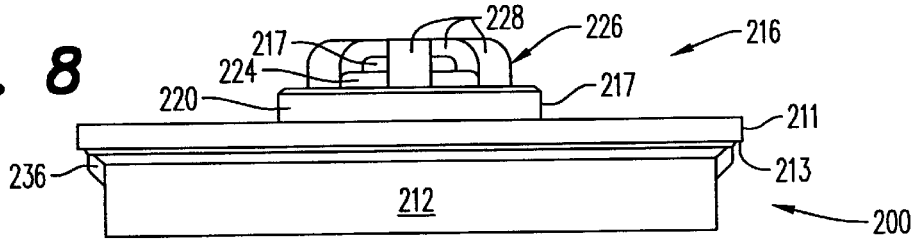
FIG. 8 is a side elevational view as would be seen along line 8—8 of FIG. 7.

FIG. 8 shows spokes 228 of hub 216, and between them, rim 224 and a portion of bore 217.

Figure 9:
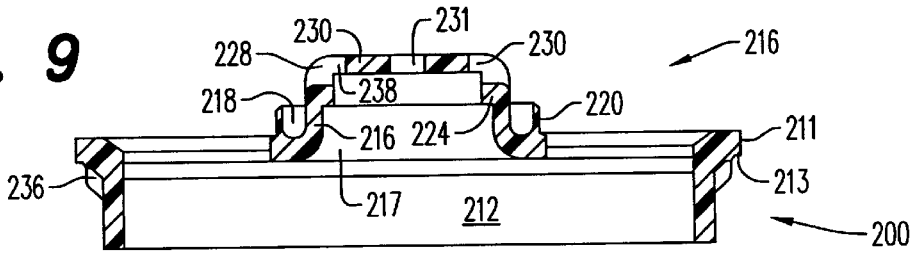
FIG. 9 is a vertical sectional view of the gasket support taken along line 9—9 of FIG. 7.

FIG. 9 shows the portions of central web 230 of hub 216 that in FIG. 5 are embedded in gasket material.

Figure 10:
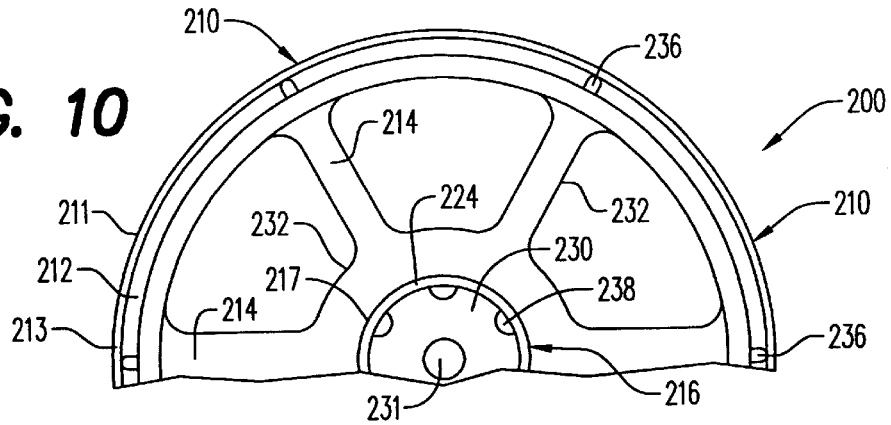
FIG. 10 is a bottom view of a portion of the gasket support shown in FIG. 7.

FIG. 10 shows rim 224, web 230, hole 231 and passageways 238 of hub 216. FIG. 10 also shows support ribs 236 spaced about the periphery of ring 210.

Figure 11:
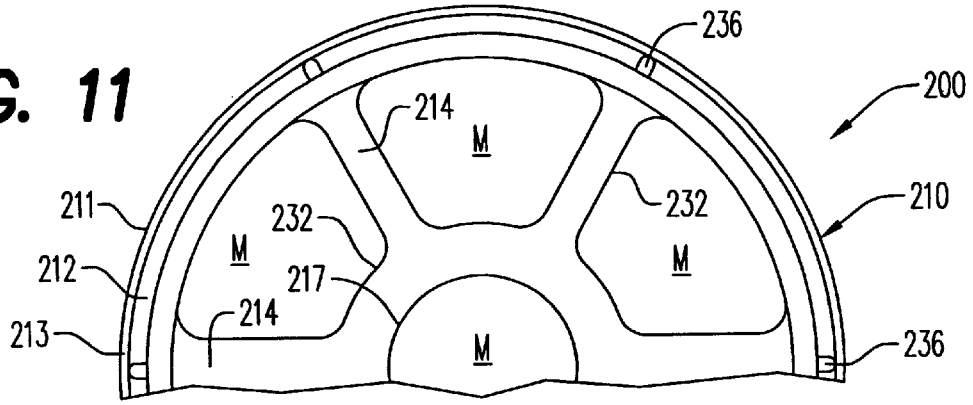
FIG. 11 is a bottom view of the gasket support portion shown in FIG. 10 after a gasket is molded onto it.

FIG. 11 shows a portion of gasket support 200 but with gasket material M molded thereto and appearing through openings 232 and in bore 217 of hub 216.

Figure 12:
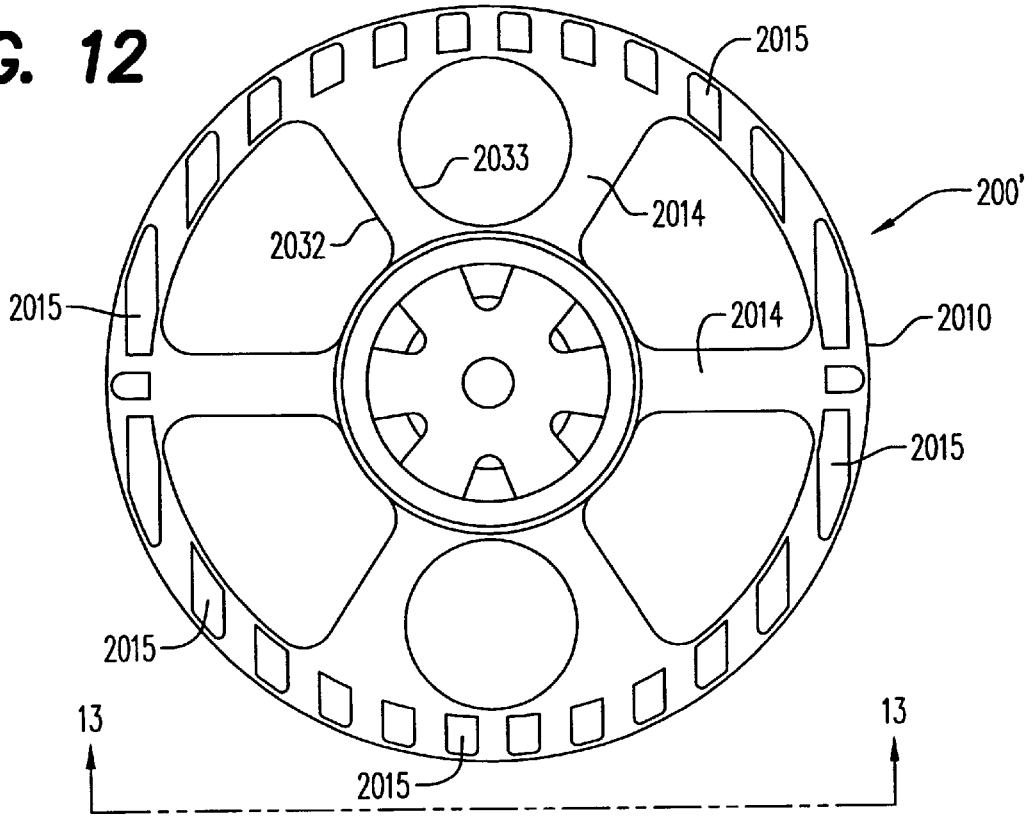
FIG. 12 is a top view of an alternate embodiment of the gasket support of the present invention.

FIG. 12 is an alternative embodiment of a gasket support 2000 of the present invention. The elements of gasket support 2000 are the same, except where indicated otherwise. Gasket support 2000 includes an annular ring 2010 whose upper surface has a plurality of variously-shaped, upwardly-extending circumferentially spaced protrusions 2015. The spokes and openings in a gasket support can be variously shaped.

Figure 13:
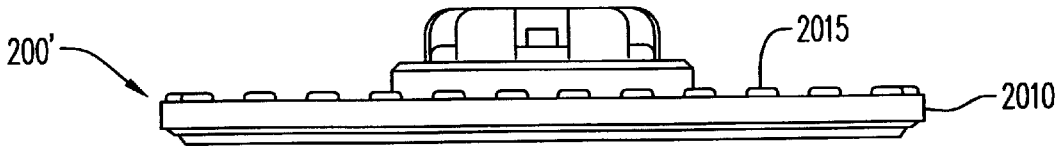
FIG. 13 is a side elevational view of the gasket support shown in FIG. 12 as seen along line 13—13 of FIG. 12.

FIG. 13 shows protrusions 2015 on an annular ring 2010 that does not have a depending skirt 212 or support ribs as in FIG. 8. Protrusions 2015 help to break up turbulence in flow of liquid from container body 300, through openings 2032, and over ring 2010 prior to exiting the opening of cap ring 22. Protrusions 2015 also prevent under surface 114 of flange 104 of gasket 100 from coming fully into contact with the upper surface of ring and, at that location, preventing flow between ring 2010 and undersurface 114.

FIG. 14 shows downward pressure being applied, as by a user's upper lip, onto conical wall 102 of gasket 100. This causes gasket 100 to flex downward about the junction of base 116 and flange undersurface 114 (not shown; see FIG. 3B), such that a radially outer portion of conical wall 102 flexes downward and an underlying localized portion of flange 104 flexes and engages a portion of ring 210 of gasket support 200.

FIG. 15 shows that downward pressure applied as in FIG. 14 typically provides a seal opening along a localized circumferential portion, which may vary but is here shown to be about 75 degrees or less of flange 104. FIG. 15 also shows (dashed lines) the approximate circumferential path of liquid flow around outer edge 107 of the portion of flange 104 that engages ring 210 of gasket support 200.

Figure 16:
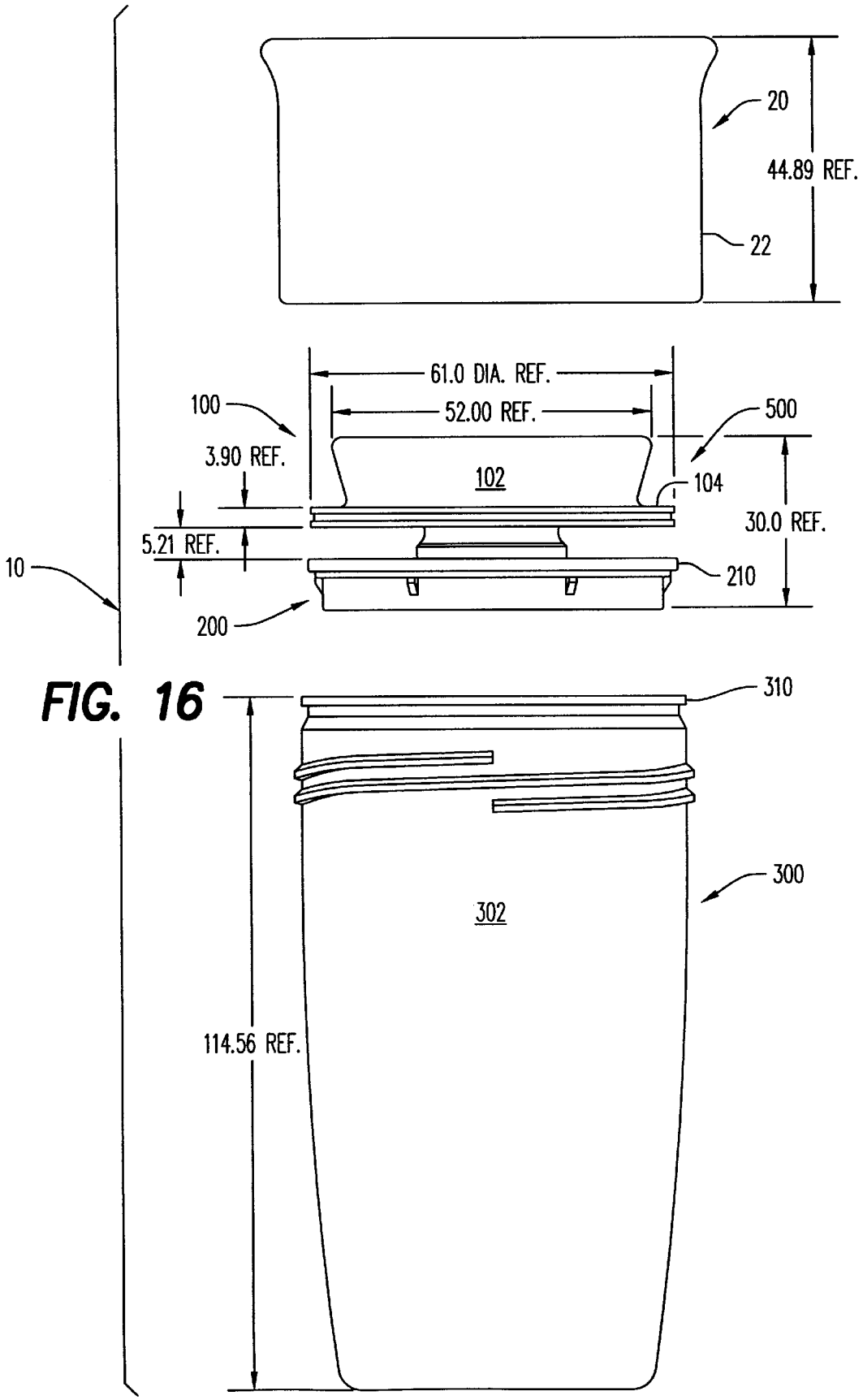
FIG. 16 is an exploded front elevational view showing dimensions of key components of a preferred container 10 of the invention.

FIG. 16 shows dimensions of key components of a preferred embodiment of container 10. "Ref" herein refers to millimeters.

Figure 17:
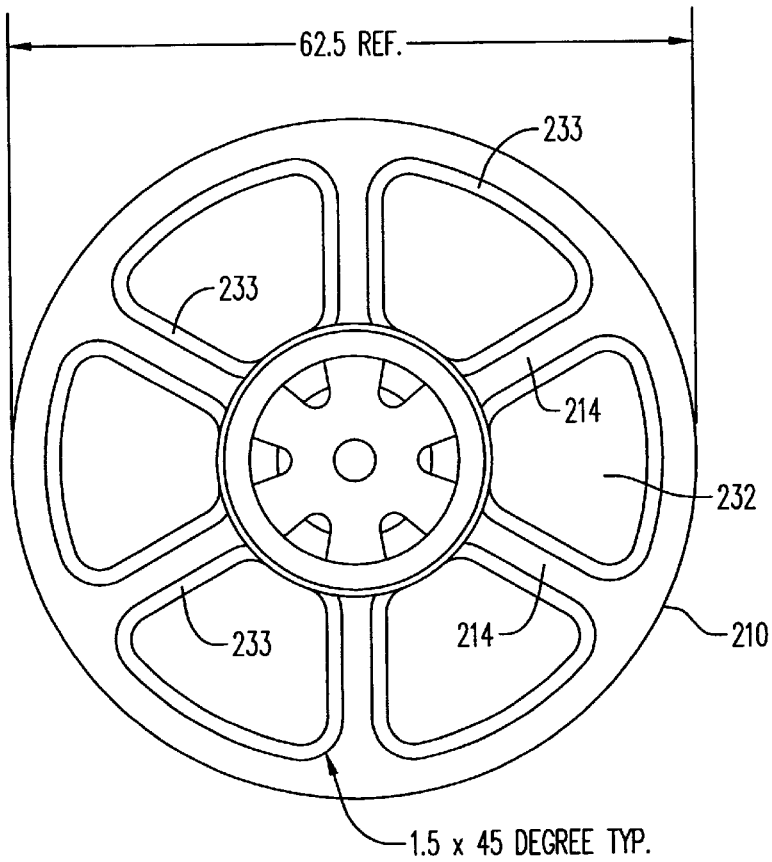
FIG. 17 is a top plan view showing a preferred gasket support of the present invention.
Figure 18:
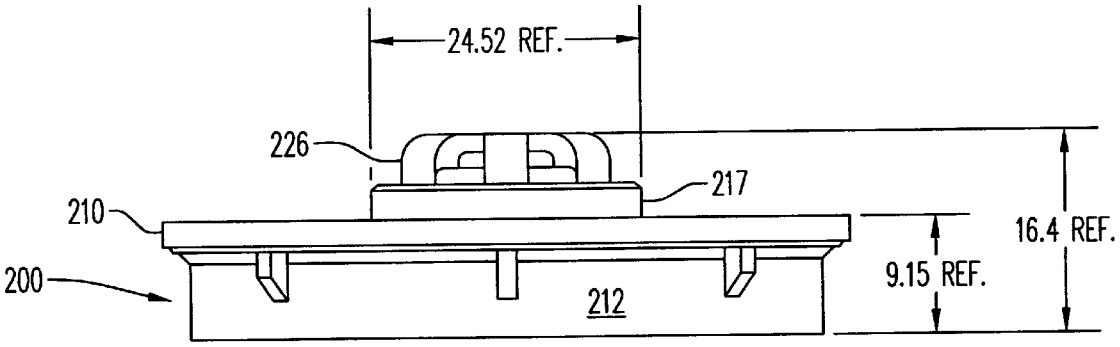
FIG. 18 is a side elevational view of the preferred gasket support of the present invention shown in FIG. 17.

FIG. 17 shows gasket support 200 having chamfered surfaces 233 about openings 232 in ring 210. FIG. 17 also shows the diameter of gasket support 200. FIG. 18 shows further dimensions of gasket support 200.

To assemble closure 20, lid 50 is inserted gasket first into the bottom opening of cap ring 22 until conical wall 102 protrudes through opening 23 at the upper end of cap ring 22. Upper surface 112 of flange 104 engages and is bent downward by corner 32 of ledge 28, and ring 210 of gasket support 200 passes over and snaps into place and its lower edge 213 sits on snap lugs 38. Lid 50 is held tightly in place from above by ledge 28 and from below by snap lugs 38. Since the axial distance between undersurface 34 of ledge 28 and the upper surface of snap lugs 38 is less than the axial distance between the upper surface of flange 104 and the undersurface 213 of outer edge 211 of ring 210, gasket 100 is held in compression such that its flange 104 is urged and biased against corner 32 of ledge 28. With lid 50 seated in position, the six support ribs 234 that are equally circumferentially spaced about ring 210, and that are preferably positioned circumferentially between snap lugs 38 engage curved surface 312 of container body wall 302 and thereby help to stabilize lid 50 and maintain it in a horizontal plane. Support ribs 234 also assist in preventing lid 50 from being pushed downwardly off of snap lugs 38 by a downward force exerted on gasket wall 102 or central panel 110.

Once closure 20 is assembled, it is threaded onto container body 300 until ridge 40 seats fully and tightly against rim 308, and side edge 310 of rim 308 engages angular surface 44 of cap ring 22. This forms a hermetic seal between cap ring 22 and container body wall 302.

To drink from the container, the user tips container 300. While resting the curved upper outer surface of wall 24 on the lower lip, the upper lip is placed on and applies downward pressure against a portion of curved inner surface of wall 102 of gasket 100. As shown in FIGS. 3B, 14 and 15, this causes gasket 100 to flex or bend at and about the junction of base 116 and flange undersurface 114, such that an underlying radially outer portion of gasket 100 that includes a localized portion of flange 104 flexes or bends and moves downward away from and unseats from corner 32 or valve seat of ledge 28. With flange 104 held or positioned either between the valve seat and the upper surface of ring 210, or, more likely, in engagement with ring 210, liquid flows from the container through openings 232, 2032, over ring 210 between it and flange 104, around the outer peripheral portion of edge 107 of any portion of flange 104 that engages ring 210, and over the inside surface of cap ring wall into the user's mouth. By use of the upper lip, the user can control the initiation, termination and volume of flow of liquid from the container body 300. By varying the pressure applied by the upper lip, it is possible to vary the gap between ring 210 and flange 104 and thereby vary the height and width of the flow stream. By narrowing or widening of the circumferential arc of expanse of applied pressure, it is possible to localize or widen the flow stream. It is also possible to localize, narrow or widen the circumferential extent of the engagement of the surfaces flange 104 and ring 210. With the application of lip pressure, the flexibility of gasket 100 provides for a localized graduated area of flexing. The amount of flexing is greatest at, under and adjacent the circumferential focal area or location of the applied pressure and the amount of flexing being gradually less progressively away from the area or location. FIG. 14 shows a downwardly concave area of flange 104 whose longest radius of curvature would be under or near the area of greatest applied pressure. As shown in FIG. 15, flexing and consequent release of flange 104 from the valve seat or ledge 28 can be localized to a segment about 75° or less of the circumference of a gasket flange having a thickness of about 3.90 mm and made of an elastomer having a durometer of about 30. Thus, in accordance with the present invention, the use of a flexible lid provides localized bending or flexing of gasket 100 and localized flow of liquid into, rather than outside either or both sides of, the user's mouth.

The operation of a particular lid 50 as an effective valve can depend upon several interrelated factors. These include, for example, the nature, properties and characteristics of the respective materials used to form the gasket and gasket support, the initial and operative spatial relationships between key elements of the components (e.g. between ledge 28 of cap ring 22 and flange 104, between flange 104 and ring 210 of lid 50, and between outer edge 107 of flange 104 and wall 36 of the cap ring), the physical dimensions of those elements, and the intended application. As will be explained, these factors may individually or in combination affect one another and tradeoffs may be necessary. Typically, the approach is to strive to employ the most flexible gasket that will obtain and maintain an effective seal given the application and intended use.

In accordance with the present invention, shown in the embodiments of FIGS. 1 through 18, gasket 100 is one or more flexible moldable materials. Preferably, the gasket material is one or more elastomeric materials. These materials are referred to herein as elastomers. They can have any suitable durometer. Suitable durometers can be from about 10 to about 70, more preferably from about 20 to about 45, and even more preferably from about 25 to about 35. The most preferred elastomer has a durometer of about 30. Preferably, it is employed to form the entirety of gasket 100. The durometer of the flexible material employed, expressed herein in Shore A hardness, will depend on several factors, including the tightness and type of seal desired, the desired ease of use and the intended application. For example, generally speaking, materials with high durometers can be placed in greater tension and can form tighter seals with the valve seat. However, they require more pressure to release them from the valve seat and thus, they are more suitable for use by adults than for children. Also, with a high durometer material, for example for a gasket, flange and ledge shaped and disposed as shown in FIG. 3, when under tension, the flange will be at an angle to the horizontal cap ring ledge or valve seat, and the seal will only or mainly be effected by or at the corner 32 or edge of the ledge. The hardness of the flange material and sharpness of the angle corner determine whether and how much the corner bites into the flange. Materials with low durometers may form seals with less tension. Thus, they can be easier to release and can be more suitable for use by children. With a gasket made of a low durometer material, the flange can be under tension and sealed against, or more flush with, a horizontal valve seat surface, e.g. along a portion or more of the undersurface 34 of ledge 28.

Preferred elastomers include those available from Shell Chemical Company under its trademark KRATON, preferably under the KRATON G family of polymer compounds. The KRATON G family of polymer compounds or elastomers are block copolymers of polystyrene-poly(ethylene/butylene)-polystyrene. These block copolymers have three discrete polymer blocks of the A—EB—A type, the end blocks (A) being hard thermoplastic and the center block (EB) being an elastomer. Usually, these block copolymers are compounded with other materials such as oils, other polymers, fillers and additives to provide the block copolymers with desired properties, such as to make them thermoprocessable. The center blocks poly(ethylene/butylene) of the G family of KRATONs are saturated elastomers and usually contain propylene. The KRATON G family of polymer compounds normally can be thermally processed at from about 375° F. to about 500° F.

For preferred embodiments of the present invention, the preferred KRATON G block copolymer elastomer has a durometer about 30. This elastomer has been found particularly useful for a gasket flange that has a diameter of about 61.00 mm, is about 3.90 mm thick, and is for use in a container for young children, such as, for example, ages 3 to 5. Elastomers having a durometer about 60 to 70 can lack sufficient flexibility, except perhaps for certain applications for adults. Gaskets having flanges made of elastomers having a durometer from about 10 to about 20 can be too flexible to form or maintain effective seals and may leak under certain conditions, such as when the container is dropped.

Elastomers having high, medium or low durometers may be blended with each other, blended or treated with other materials, or physically modified to render them respectively more or less flexible generally or in desired localized areas. For example, one material of moderate or high durometer can be used with another material of low durometer, each material being used in a different part of the lid or gasket to achieve the desired seal, ease of use and flow characteristics. As examples, the low durometer material can form the base or upper central portion of the gasket, and the higher durometer material can be used to form all or a portion of the flange. As other examples, the high durometer material can form a more rigid central portion and/or base, either or both of which can joined directly or indirectly, e.g. through a moderate or low durometer joint, to a moderate or low durometer flange. Also, a low durometer material can be selectively positioned to be operative in a selected localized portion of an otherwise more rigid gasket, as when drinking is to be effected only at that location of the gasket or lid. Further, a lid 50 can be formed in one piece with a gasket support portion that is inflexible, i.e. rigid, an upper portion having the desired flexibility in the desired locations.

Gasket support 100 can be made of any sufficiently rigid material. The gasket support should not bend or flex so that it does not become dislodged or mispositioned in the cap ring and so that bending or flexing occurs substantially or exclusively in the gasket material. Examples of suitable materials include a polyolefin, polyethylene, polypropylene and polycarbonate in either a polymer or copolymer. Although for certain applications, e.g. for containers for low temperature liquids, a high density polyethylene may be employed, the preferred material for forming gasket support is a propylene polymer or copolymer. The preferred propylene polymer is polypropylene.

Likewise, cap ring 22 can be made of any rigid material. Although for certain applications it can be made of a polyolefin, such as high density polyethylene, the preferred material is a propylene polymer or copolymer. The preferred propylene polymer is polypropylene.

Container body 300 can be made of the same materials as cap ring 22. Preferably, it is made of the same polypropylene.

Important considerations for the effective operation of container 10 are the spatial relationships of elements of closure 20. For example, if the distance between ring 210 of gasket support 200 and ledge 28 is not great enough, there may be insufficient space available for flange 104 to bend downwardly to allow flow of liquid when flange 104 is unseated from ledge 28. If ring 210 is lowered relative to ledge 28 to create space for the flange to bend downwardly sufficiently, there may not be enough tension exerted by ledge 28 against the flange to effectively seal it against the ledge 28.

One factor that affects flow of liquid from lid 50 is the space S or distance between flange 104, especially its outer peripheral side edge 107, and cap ring wall 36. Shortening flange 104 increases the space and the flow of liquid between its peripheral side edge 107 and wall 36 of cap ring 22, but may excessively reduce its flexibility and/or its ability to provide an effective seal that resists opening. Reinforcing flange 104 in some manner, as preferred, with an annular rigid ring 126 of polypropylene allows shorter flange diameters, better flow and sufficient resistance to flange pop-out during drop tests.

Closure 20 has certain features to minimize the accumulation of liquids on upper surfaces of internal components, and the possibility of accumulated droplets of liquid from falling from the cap ring 22 onto the user or outside of the container body when the cap ring is removed from container body 300. Removal of cap ring 22 disturbs or breaks the surface tension between the accumulated liquid and the surfaces on which the droplets reside. Thus, surface areas for accumulation of liquid are minimized and features are provided to drain accumulated liquid into container 300. For example, the upper surfaces of spokes 214 of gasket support 200 are chamfered at 233 (FIG. 7). Also, the radial extent of rim 308 of container body wall 302 is minimized and inner curved surface 312 is provided on body wall 302 adjacent and below rim 208 to facilitate the desired drainage. Support ribs 236 and ring 212 about the periphery of gasket support also facilitate the desired drainage into container body 300.

Lid 50 can be formed in the following manner. Gasket support 200 was the polypropylene copolymer injected into first mold cavity under conventional injection molding conditions and temperatures. Gasket support 200 was then transferred to another mold cavity where the KRATON G elastomer was overmolded onto gasket support 200 such that gasket material flowed into U-shaped channel 218, into and through hole 231 and openings 234, through passageways 238 and into bore 217 of hub 216. The resulting lid having gasket 100 overmolded onto and thereby unitary with gasket support 200 was cooled sufficiently and removed from the mold cavity.

It is contemplated to be within the scope of this invention that instead of, for example, locking lid 50 to cap ring 22 or confining it to an area in cap ring 22 between snap lugs 38 and ledge 28 to place gasket 100 and/or its flange 104 in tension, this can be done in another manner. For example, lid 50 can be held or supported by suitable structure, e.g. on the container body, and cap ring 22 can place gasket 100 and/or its flange 104 in tension when it is secured , e.g., threaded onto the container body.

Figure 19:
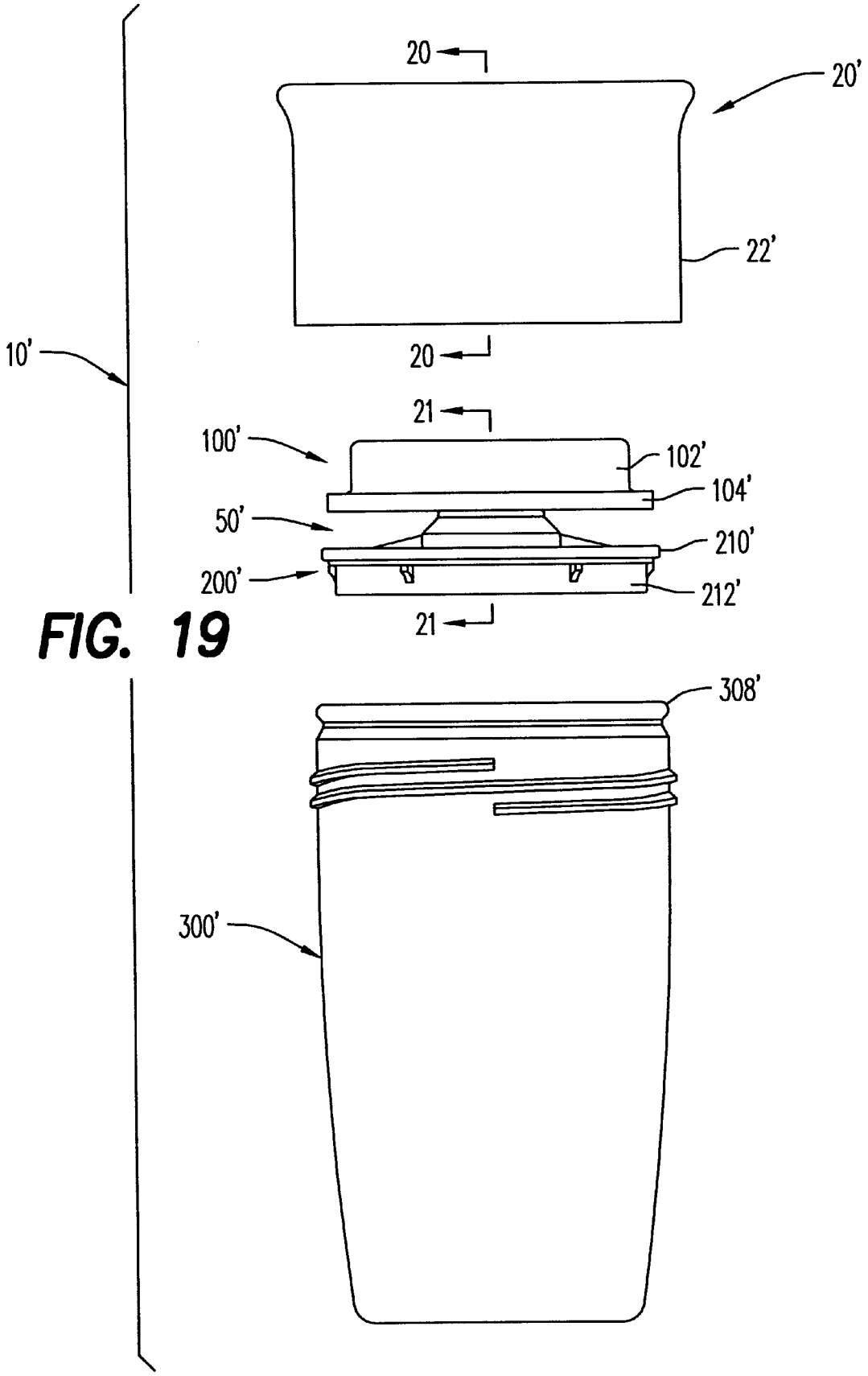
FIG. 19 is an exploded side elevational view, with portions broken away, of main components of an alternative, second embodiment of the container of the invention.

FIGS. 19 through 30 show a second, more preferred, embodiment of the container and lid of the invention. More particularly, FIG. 19 shows a container 10' comprised of a closure 20', a cap ring 22', a lid 50' and a container body 300'. Lid 50' is a gasket assembly comprised of a movable gasket 100' and a gasket support 200'.

Figure 20:
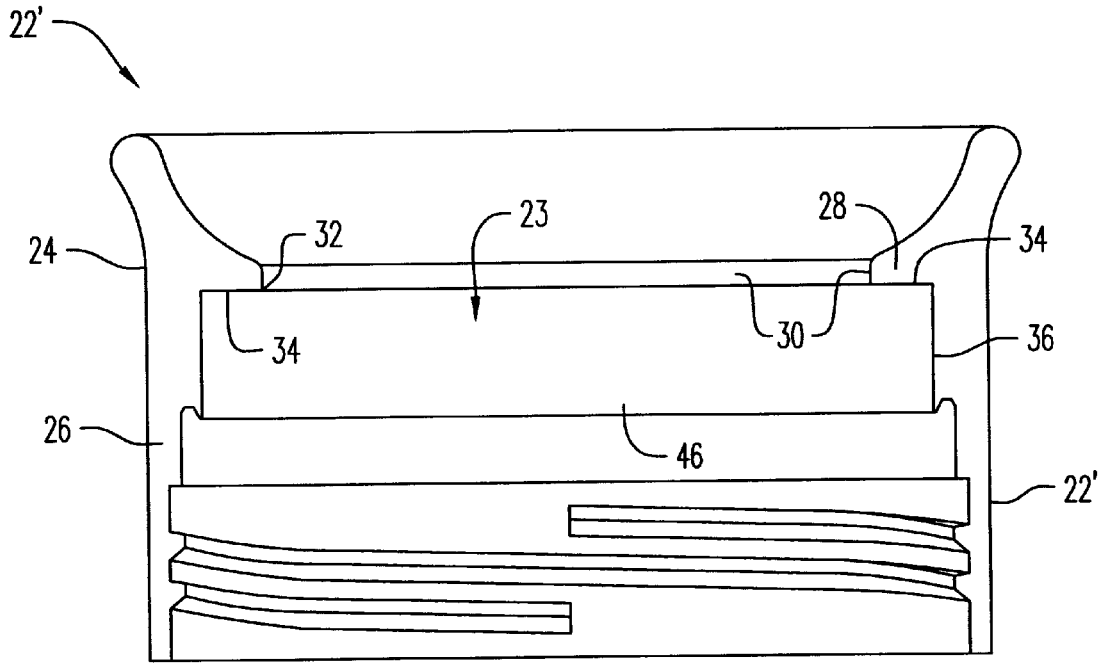
FIG. 20 is a vertical sectional view taken along line 20—20 through the cap ring shown in FIG. 19.

FIG. 20 shows that cap ring 22' of container 10' is basically the same as cap ring 22 of container 10, except that cap ring 22' does not have snap lugs (38) for supporting a lid thereon, and cap ring 22' has sealing means in the form of a depending integral annular conical sealing finger 46 for engaging and sealing rim 308' of container body 300' and assisting in hermetically sealing cap ring 22' to container body 300'.

Figure 21:
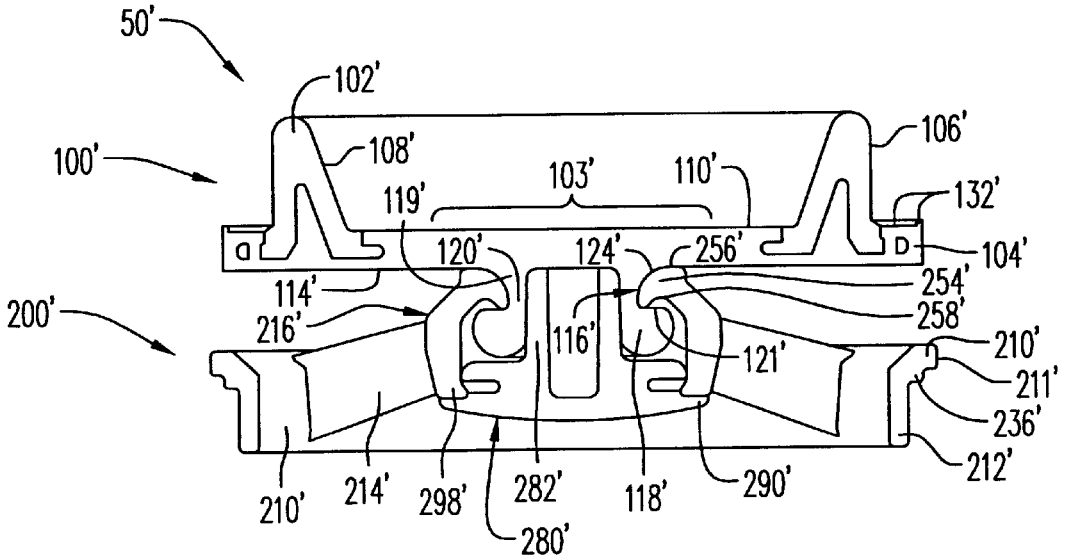
FIG. 21 is a vertical sectional view taken along line 21—21 of the lid (gasket assembly) shown in FIG. 19.

FIG. 21 shows lid 50' with its gasket 100' mounted on and secured to gasket support 200'. As shown in FIG. 21, and also in FIG. 22, gasket 100' has an upstanding lip-engageable rigid annular wall 102' that has a cylindrical outer surface 106' and a conical inner surface 108'. Gasket 100' has a recessed central panel 110', radially inward of wall 102', and an annular peripheral flange 104' extending radially outwardly from wall 102'. The upper surface of flange 104' preferably has an upstanding peripheral annular sealing bead 132' thereabout for improved sealing of flange 104' to valve seat 34 of cap ring 22'. Central panel 110' and flange 104' of gasket 100' are comprised of a flexible elastomer such as is previously described herein as being suitable for forming gasket 100'. Suitable durometers of the flexible elastomer, for the FIGS. 19 through 30 embodiments, can be from about 30 to about 50. The most preferred elastomer has a durometer of about 40.

Central panel 110' of gasket 100' has an undersurface 114' that merges into an integral depending cylindrical central trunk 116' for securing gasket 100' to support 200'. Central panel 110' also has a central portion generally designated 103', that is an area adjacent, at or about, including radially inward of, the junction 124' of undersurface 114' and trunk 116'. Trunk 116' includes a neck 117', and retaining means in the form of an annular retaining ring 118' disposed about the lower end of trunk 116', for engaging support 200'. Trunk 116' also has an upwardly extending concave dead end bore 130'.

Neck 117' of trunk 116' is undercut with an annular downwardly sloped concavely curved surface 119' that forms a reduced diameter portion 120' that extends between undersurface 114' and retaining ring 118' and merges with an outwardly extending horizontal locking surface 121'. Curved surface 119' and reduced diameter portion 120' facilitate bending or flexing and/or stretching of the elastomer material of gasket 100' in the area of central portion 103' and trunk 116' when downward pressure is applied to annular wall 102' of gasket 100'.

Figure 27:
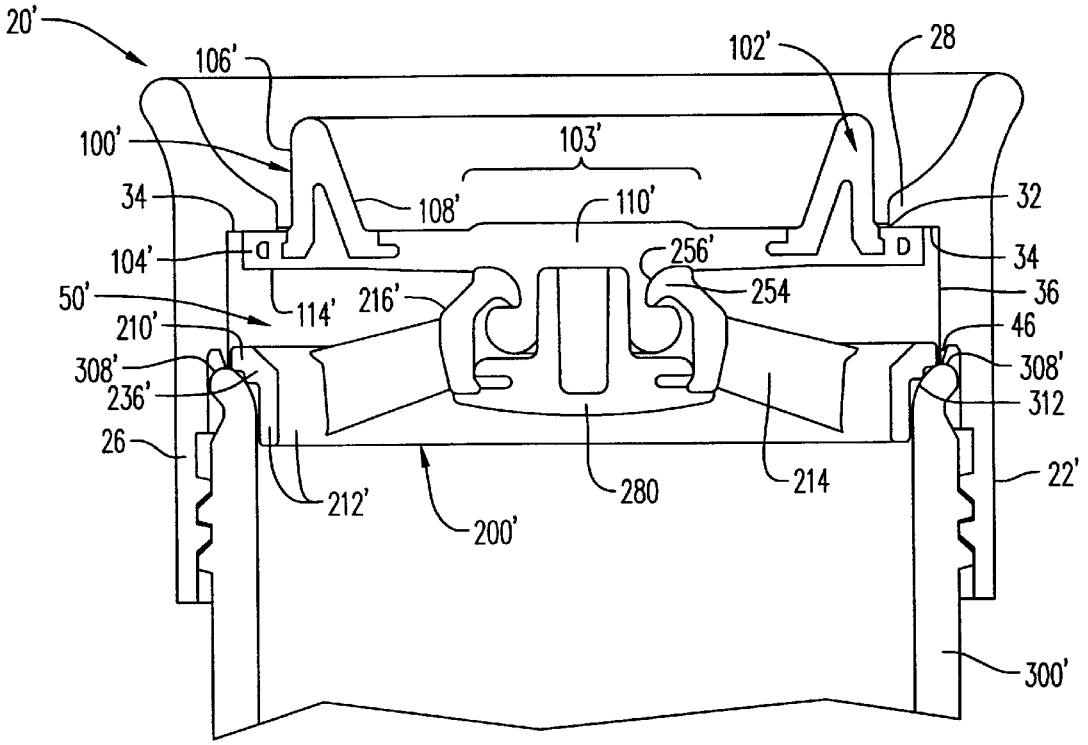
FIG. 27 is a vertical sectional view, with portions broken away, of the container of FIG. 19 fully assembled, and with the gasket of the lid in the closed position.
Figure 28:
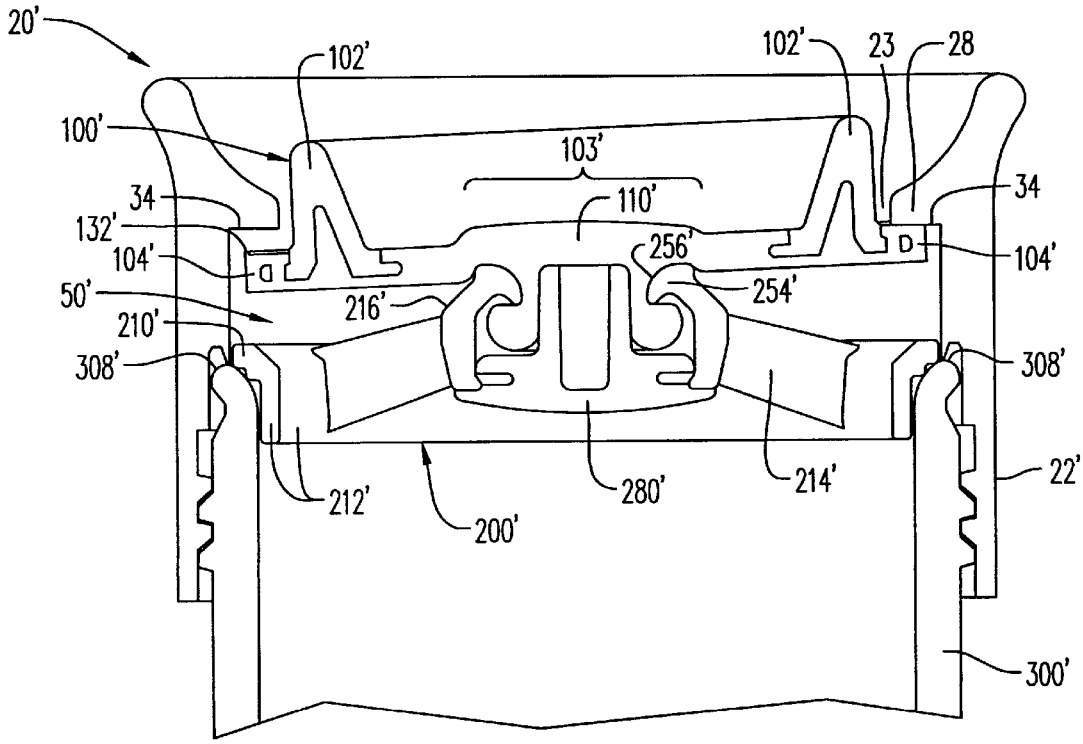
FIG. 28 is a vertical sectional view as in FIG. 27 with the gasket of the lid in an open position.

Gasket support 200' preferably is a rigid structure. As shown in FIG. 21, gasket support 200' supports gasket 100', preferably its central portion 103', and as shown in FIGS. 27 and 28, positions gasket 100' against valve seat 34 of cap ring 22'. More particularly, gasket support 200' maintains the upper surface of flange 104' of gasket 100' in normal sealing engagement with valve seat 34 of cap ring 22'. Annular ring 210' of gasket support 200' is adapted in terms of size and having surfaces that permit ring 210' to be sustainable or supportable and maintained in position by contact or engagement with a surface of a container cap or cap ring, or of a container.

Figure 22:
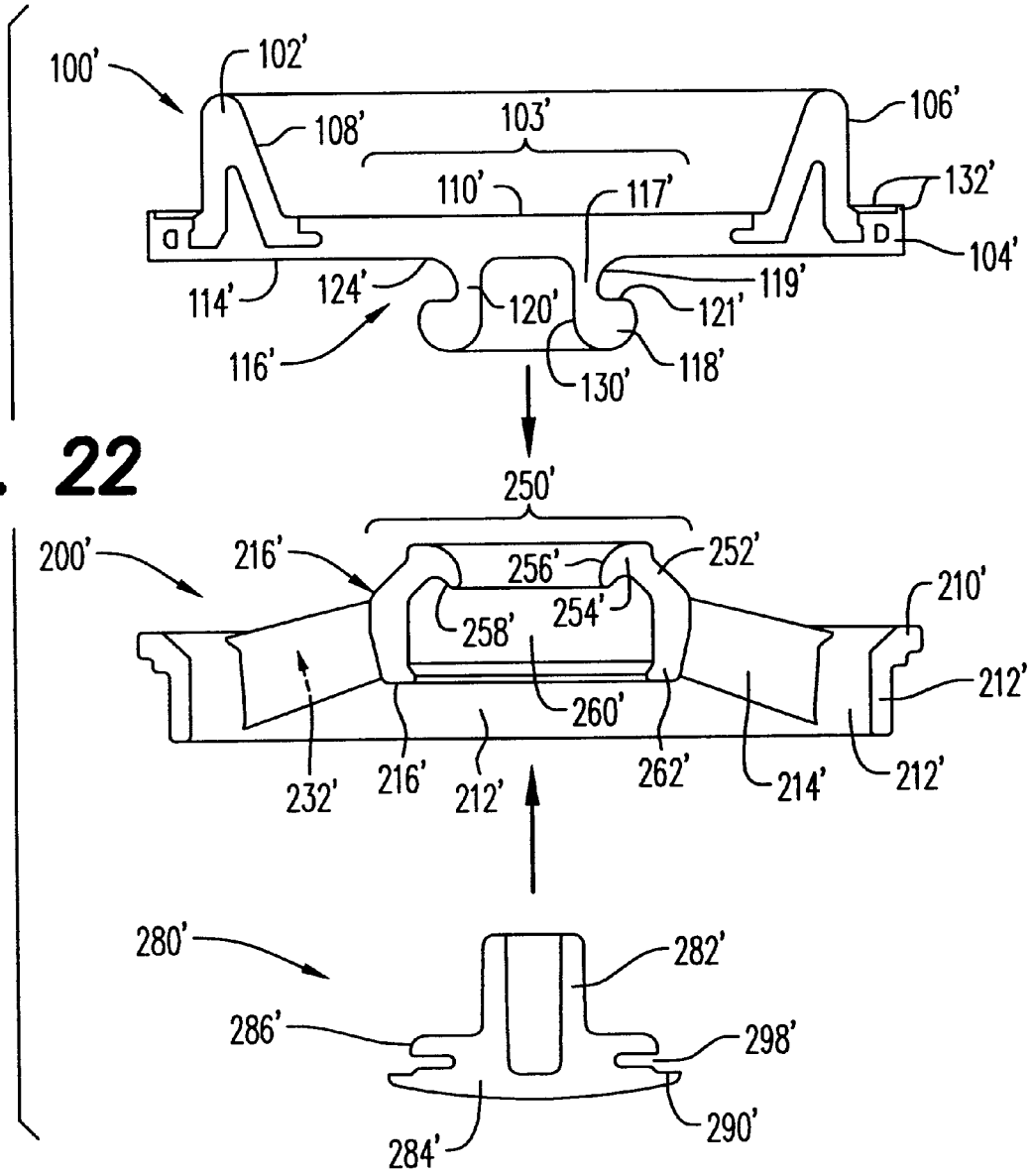
FIG. 22 is an exploded vertical sectional view of the lid shown in FIG. 21.

As shown in FIG. 21, and also in FIG. 22, gasket support 200' is comprised of a base, preferably in the form of an annular peripheral ring 210' having a depending skirt 212', a central section 250', and one or more connecting members, preferably radially extending spokes 214', that connect ring 210' to hub 216'. Between them, these structures define liquid flow openings 232' through gasket support 200' to allow liquid to flow from the interior of a container body through gasket support 200', and, as shown in FIG. 28, under a displaced portion of flange 104' of gasket 100' and out opening 23 of cap ring 22'. The lower portion of outer edge 211' of skirt 210' and support ribs 236' are positioned to engage a cap or container to sustain gasket support 200' thereon.

Central section 250' of gasket support 200' preferably is rigid and preferably includes an upstanding annular hub 216' comprised of an annular conical wall 252' with engaging means, preferably a head in the form of an annular bead 254' having a downwardly and inwardly sloped convex arcuate bearing surface 256' with an undercut 258', for engaging retaining ring 118' at the bottom of trunk 116' of gasket 100', and securing, preferably flexibly, gasket 100' to gasket support 200'. Hub 216' has a cylindrical bore 260 therethrough and the lower end of hub 216' has a radially inwardly extending annular protrusion 262' thereabout.

As shown in FIG. 22, lid 50' preferably also includes a plug, preferably a rigid plug 280', having a cylindrical stem 282' and a head 284' in the form of a disc whose peripheral side edge 286' has a radially inward annular groove 298' therein, for receiving and tightly engaging annular protrusion 262' of hub 216'. Plug 280' also has a radially outwardly extending peripheral stop surface 290' for preventing plug 280' from being inserted too far into bore 130 of trunk 116' of gasket 100'.

To assemble lid 50' shown in FIG. 21 from the components of lid 50' shown in FIG. 22, flexible trunk 116' of gasket 100' is inserted into bore 260' of rigid hub 216' of gasket support 200' until retaining ring 118' of trunk 116' passes annular bead 254' of hub 216', bearing surface 256' enters the annular channel formed by curved surface 119' of trunk 116', and horizontal surface 121' of retaining ring 118' and annular bead 254' interengage. This secures gasket 100' to gasket support 200'. To improve the securement of these members, stem 282' of plug 280' is inserted into and seated in bore 130' of trunk 116' of gasket 100' until annular protrusion 290' of plug 280' engages annular groove 298' of plug 280'.

Since the diameter of stem 282' of plug 284' is greater than the diameter of bore 130' of trunk 116', the insertion of stem 282' into bore 130' reduces space, if any exists, between the flexible material of trunk 116'. The insertion also compresses the flexible material of trunk 116' against hub 216'. The reduction in space and compression of material (compression not shown in drawings) improves the securement of gasket 100' to gasket support 200'. This securement of gasket 100' to gasket support 200' is advantageous because it renders lid 50' difficult to take apart, not only because of the above-mentioned engagements and compressive action, but also because of the tight joint between and the smooth outer surface contour of the periphery of head 284 of plug 280 and of the bottom of hub 216' of gasket support 200'. These factors make it difficult, especially for a child, or without tools, to remove plug 280' from hub 216'. The securement is also advantageous because head 284' of plug 280' hermetically seals the lower end of hub 216'.

Figure 24:
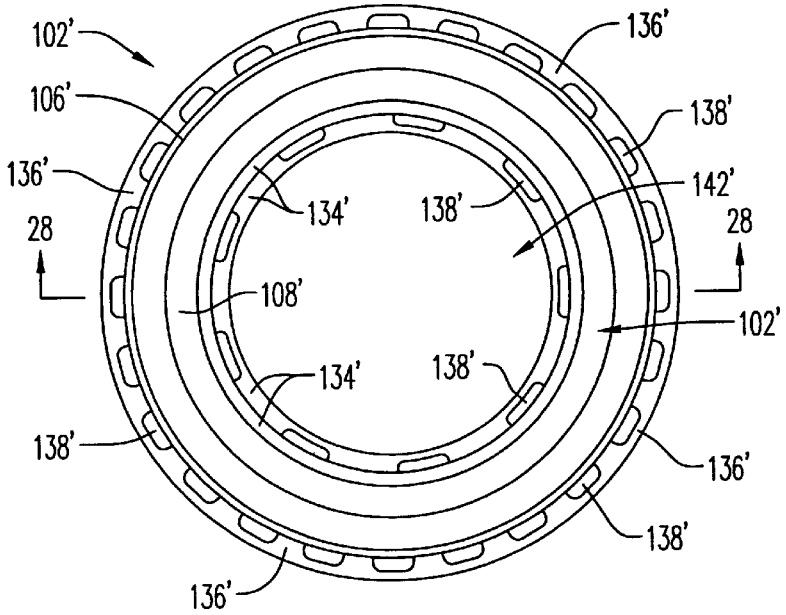
FIG. 24 is a top view of the annular wall shown in FIG. 23.
Figure 23:
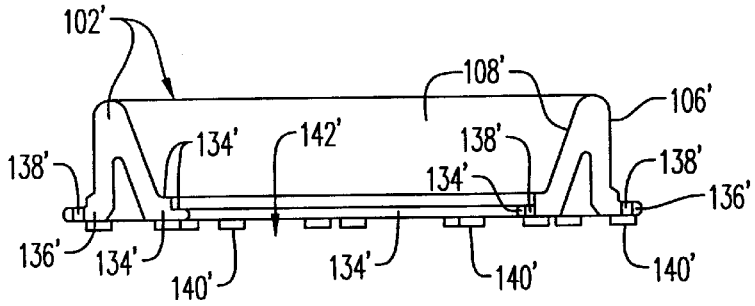
FIG. 23 is a vertical sectional view of the annular wall of the gasket shown in FIG. 22 prior to the annular wall having elastomer material overmolded onto portions of the wall.
Figure 25:
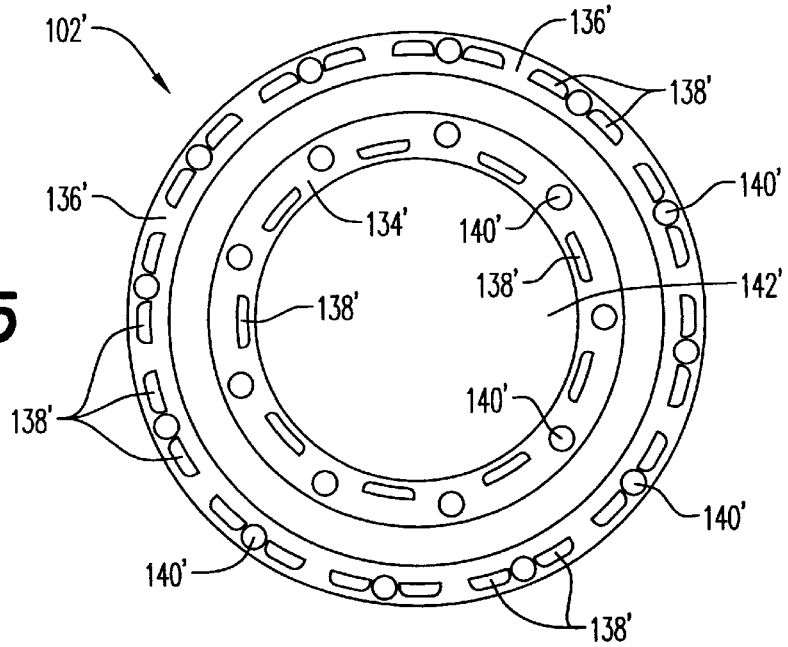
FIG. 25 is a bottom view of the annular wall shown in FIG. 23.

FIGS. 23 through 25 show annular wall 102' before it has flexible moldable material, preferably, elastomeric material, overmolded or otherwise connected or joined to it. Wall 102' is comprised of a rigid structural material, such as is previously described herein as being suitable for forming gasket support 200'. Preferably, wall 102' is made of polypropylene. Wall 102' provides a rigid ring or annular frame onto which elastomeric material can be joined. Wall 102' has a central opening 142', and a portion with a radially inwardly extending annular lip 134', and a radially outwardly extending annular lip 136'. Each lip 136', 138' has elongated holes 138' extending vertically therethrough, and a bottom surface with cylindrical protrusions 140' depending therefrom. Holes 138' and protrusions 140' assist in joining elastomer material to lips 136' and 138' of wall 102'. When elastomer material is joined with or molded onto (hereafter "overmolded") onto lips 136', 138' at elevated temperatures, the molten elastomer flows in a mold onto and about lips 136', 138'. Molten elastomer flows into, and preferably through, holes 138', joins, welds, or fuses to itself on opposite sides of the respective lips, and flows around and encompasses protrusions 140', to mechanically join the elastomer material to wall 102' and form integral gasket 100'.

Figure 26:
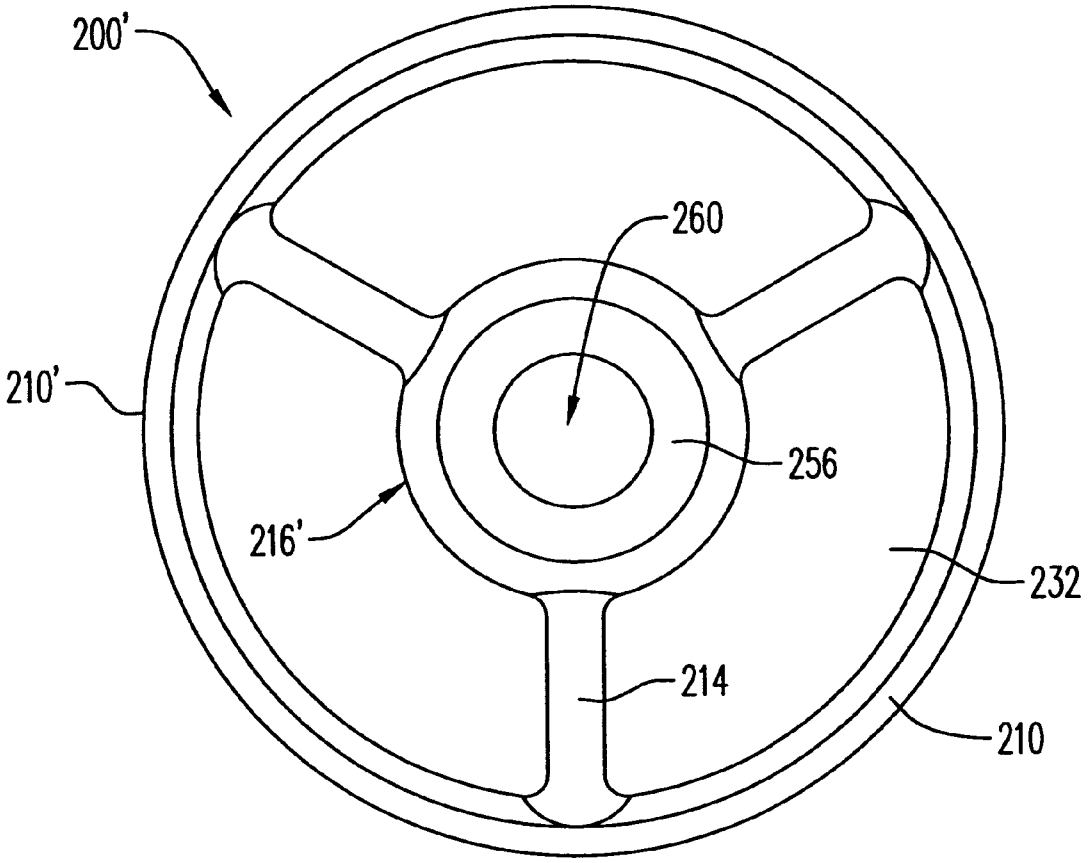
FIG. 26 is a top view of the gasket support shown in FIG. 22.

FIG. 26, a top view of gasket support 200' shown, for example, in FIG. 22, shows annular ring 210' joined to central annular hub 216' by circumferentially spaced radial spokes 214'. FIG. 26 also shows annular bearing surface 256' and bore 260' of hub 216', as well as openings 232' defined by ring 210', hub 216' and spokes 214'.

FIG. 27 shows lid 50', more particularly, its ring 210' and its support ribs 236', seated on rim 308' of container body 300', and cap ring 22' threaded onto and hermetically sealed-to container body 300' with lid 50' held between rim 308' and. its curved inner surface 312 of container body 308' and valve seat 34 of ledge 28 of cap ring 22'. The hermetic seal is obtained by the interengaging threads of cap ring 22' and container body 300' and by integral annular sealing finger 46 of cap ring 22' that contacts and'seals against rim 308' of container body 300'. Gasket support 200' could instead be supported or sustained by contact with any suitable surface, for example, radially inwardly projecting snap lugs 38 on the inner surface of cap ring 22, as employed in the first embodiment of the container of the invention.

FIG. 27 shows flange 104' of gasket 100' in the closed position. As shown in FIG. 27, portions of central portion 103' of central panel 110' are in tension on hub 216' of gasket support 200', and flange 104' is biased and hermetically sealed against valve seat 34 of ledge 28 of cap ring 22'.

FIG. 28 shows flange 104' in an open position. FIG. 28 shows that when downward pressure is applied by a user's lip or otherwise to a portion, here, a left-hand portion, of wall 102', the pressure bends or flexes and stretches a portion of central portion 103' of gasket 100' downward. This displaces flange 104' from valve seat 34 of ledge 28 of cap ring 22' and creates a passageway for flow of liquid from container body 300' through its opening 23. As shown in FIG. 28, when a rigid support such as bearing surface 256' of hub 216' is employed to support central panel 110' of gasket 100', some bending or flexing and stretching occurs downward from and over bearing surface 256', especially over its peripheral edge. Some bending or flexing and stretching also occurs along and through the portion of central panel 110' radially outward of junction 124' in the general direction toward where pressure is being applied to wall 102' of gasket 100'. Some stretching also occurs in or along the portion of central panel 110' above and even to the right of hub 216' of gasket support 200'.

Figure 29:
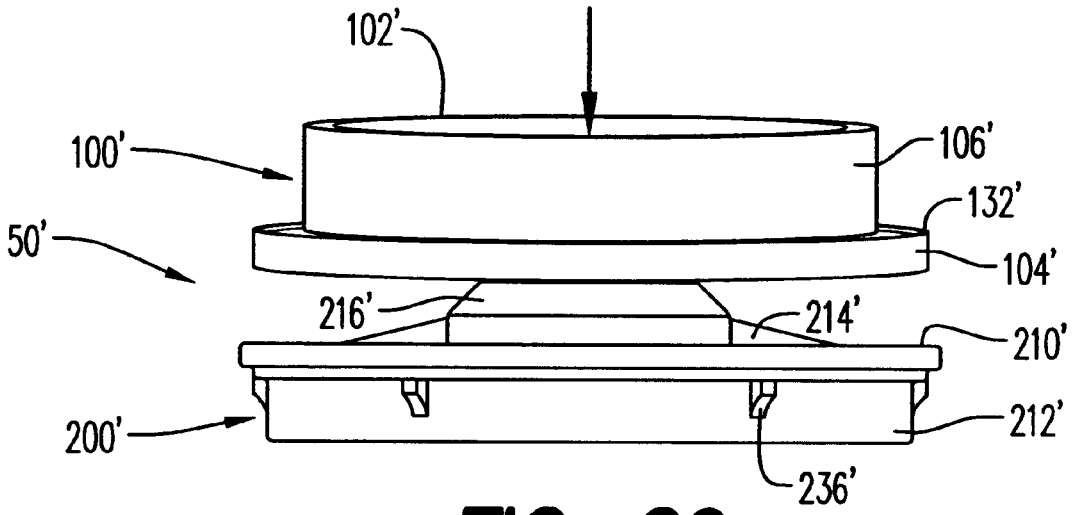
FIG. 29 is a side elevational view of the lid shown in FIG. 19 with the gasket tilted downward in an open position as shown in FIG. 28.

FIG. 29 is a side view showing gasket 100' of lid 50' in the tipped position shown in FIG. 28. Depending, for example, on the radially outward extent of lip 136' of wall 102', and the thickness of elastomer material above and peripherally beyond lip 136', there may be compression, flexion and/or elongation of elastomer material of flange 104' in an area approximately 180° from where the downward pressure is exerted on wall 102', where that area of flange 104' is placed in greater than initial tension with valve seat 34 of cap ring 22'.

Figure 30:
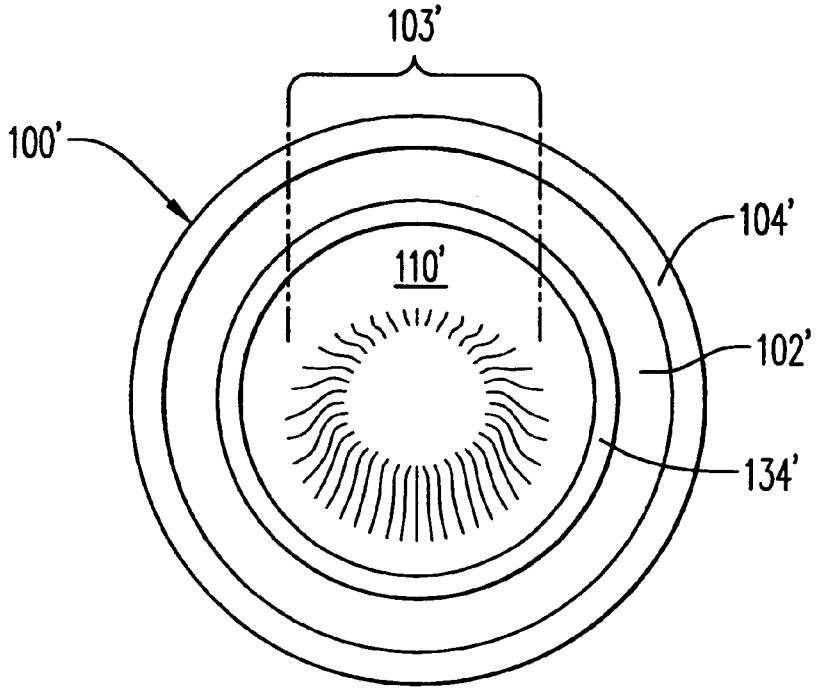
FIG. 30 is a top view of the gasket of the lid shown in FIG. 29.

FIG. 30 is a top view of gasket 100' of lid 50' shown in FIG. 29 in a tipped or open position. FIG. 30 schematically shows by shading, some of the flexing or bending and stretching of central panel 110' that occurs in the area over, about and radially outward from the portion of central panel 110' that overlies bearing surface 256' of hub 216' of gasket support 200'.

The securing means of the invention for securing a gasket 100, 100' to a gasket support 200, 200' can be part of the gasket, part of the gasket support, part of both, part of neither, or a combination of the foregoing. The securing means of the invention can be any suitable means such that, upon the application of downward pressure to the gasket, the elastomer material of the gasket bends or flexes and possibly, preferably, stretches downward to displace a portion of the gasket, usually of the flange of the gasket, from the valve seat. Preferably, the displacement is effected by bending or flexing and stretching the elastomer material of the gasket downward from, and/or downward over underlying rigid structure, preferably of the gasket support.

The securing means of the invention for securing gasket 100 to gasket support 200 include central trunk 116 that is integral with and depends from gasket 100, and retaining means in the form of annular retaining ring 118 that is integral with trunk 116 and positioned and held in U-shaped channel 218 of gasket support 200. The securing means of gasket support 200 for securing gasket 100 to gasket support 200 include an upwardly extending annular hub 216 having a lower U-shaped channel 218, an annular rim 224, and a central web 230 with a central hole 231 and spokes 228 with openings 234 therein, for flowing elastomer material thereabout and therethrough during overmolding of gasket 100 onto gasket support 200. Once overmolded, lid 50 is one piece.

The securing means of the invention for securing gasket 100' to gasket support 200' include central trunk 116' that is integral with and depends from gasket 100', and retaining means in the form of annular retaining ring 118' that is integral with trunk 116' and that includes a locking surface 121' for interengaging and interlocking with undercut 256' of annular bead 254' of gasket support 200'. The securing means of gasket support 200' for securing gasket 100' to gasket support 200' include upwardly extending annular hub 216' having an annular conical wall 252' with engaging means in the form of an annular bead 254' with undercut surface 258', for engaging retaining ring 118' of trunk 116' of gasket 100'.

The securing means of the invention also includes a plug 280' that is not part of either the gasket or the support, for insertion into and engaging bore 130' of gasket 100' and receiving annular bead 262' of hub 216' of gasket support 200', to thereby join the gasket and the gasket support.

The securing means of the invention further includes the use of a gasket that is formed in one piece or made integral with the gasket support. For example, the gasket and gasket support can be molded of a combination of elastomers of different durometers as discussed above, such that, for example, the gasket support can be formed of a high durometer elastomer and the gasket or portions thereof can be formed of a low durometer material.

Securing means considered suitable include, but are not limited to, various openings and channels and forms, e g., webs and protrusions, employable in overmolding, as well as various male/female, tongue/groove, pin,snap, clamp, hook, latch, sleeve, and other couplers and systems. These securing means are such that the components of the lid will not come apart during use.

As disclosed in the foregoing, a main concept of the invention is to use as a gasket material in a drinking container or lid assembly for a drinking container, an elastomer material, (which, by definition, is capable of flexing, stretching and recovering), as the, or a portion of, preferably the central portion of the, gasket, in combination with structure, preferably support structure, that causes the elastomer of the gasket to bend or flex and stretch, or just stretch, when downward pressure is applied to or through the gasket to displace it from a valve seat. Although in the preferred embodiments disclosed herein, a rigid support, preferably made of a structural polymer, e.g. a polypropylene, is employed, it is to be understood that a "rigid support" herein broadly includes a support that is merely sufficiently more rigid than the elastomer of the gasket, such that upon the application of pressure to or through the gasket, the gasket will bend or flex and possibly stretch, or merely stretch, to displace the gasket from a valve seat. It is also to be understood that in the first embodiment, there is bending or flexing and stretching of elastomer material of gasket 100 upon the application of downward pressure to gasket 100. For example, stretching occurs in neck 117 in an area opposite to where pressure is applied to gasket 100. Also, in the embodiment shown, some stretching occurs in wall 102 adjacent where the pressure is applied to the wall. However, in the second embodiment, the bending or flexing of central panel 110' of gasket 100' is more gradual, and stretching thereof is less or non-existent, given the radial and axial offsetting of web 230 and ring 224 of hub 216 of gasket support 200', and given that wall 102 of gasket 100 is itself comprised of elastomer material and undergoes some bending or flexing and possible stretching when it is subjected to downward pressure.

The tensile modulus of the elastomeric material is from about 300 psi to about 550 psi, at 300% elongation. Preferably the tensile modulus of the elastomeric material is 339 psi. This elastomeric material is commercially available under the tradename Versaflex, and is sold by GLS Corp. Information concerning the Versaflex material and the range of the modulus of this material is shown on the attached technical data sheets that were submitted with this application. The most preferred material is Versaflex CL2042X.

Having thus described the lid and container of the invention with particular reference to preferred embodiments thereof, it will be apparent that various changes and modifications may be made therein without departing from the spirit and scope of the present invention.

What is claimed is:

1. A lid for use in connection with a container or container cap having an inwardly extending ledge that forms a valve seat and defines an opening for egress of container contents therethrough, the lid comprising:

a gasket having a diameter that is larger than the opening, and having a central panel that is made of a flexible elastomer, and a flange that is engageable with the valve seat; and a support that supports said central panel of said gasket, said support being sustainable by a surface of the container or container cap and, when so sustained, said support being capable of positioning said gasket against the valve seat of the cap, wherein said central panel of said gasket is capable of flexing and stretching to allow a portion of said flange to be displaced from the valve seat when downward pressure is applied against a portion of said gasket.

2. The lid of claim 1, wherein said flexible elastomer has a durometer from about 30 to about 50 Shore A.

3. The lid of claim 1, wherein said support is rigid and when said downward pressure is applied against said gasket, said central panel of said gasket contacts said rigid support and a portion of said central panel of said gasket flexes downward from said rigid support.

4. The lid of claim 1, wherein said support is rigid and when said downward pressure is applied against said gasket, said central panel of said gasket contacts said rigid support and a portion of said central panel of said gasket stretches downward from said rigid support.

5. The lid of claim 1, wherein said support is rigid, and said support has a rigid bearing surface under said gasket, such that when said downward pressure is applied against said gasket, a portion of said central panel of said gasket contacts said bearing surface and stretches downward over said bearing surface.

6. A lip-openable lid for use in connection with a cap for a container, the cap having a skirt and an inwardly extending ledge that forms a valve seat and defines an opening, the lid comprising:

a gasket having an upstanding lip-engageable wall, said wall having a diameter and height that allows it to fit upward through the opening and beyond the ledge, a central panel radially inward of said wall, and comprised of a flexible elastomer; and a flange extending outward from said wall and being engageable with said valve seat;

a rigid support that supports said central panel of said gasket, said support having a base, a central section connected to said base, and liquid flow openings extending through said support, said base being sustainable by a surface of the cap or the container and, when so sustained, said support being capable of positioning said upper surface of said flange of said gasket against said valve seat of said cap; and means for securing said central panel of said gasket to said central section of said support, wherein said flexible elastomer flexes and stretches to allow a portion of said flange to be displaced from said valve seat when lip pressure is applied against an adjacent portion of said wall of said gasket.

7. The lid of claim 6, wherein said lip-engageable wall is rigid.

8. The lid of claim 6, wherein said lip-engageable wall is annular.

9. The lid of claim 6, wherein said securing means comprises part of said gasket.

10. The lid of claim 9, wherein said securing means is a flexible elastomer.

11. The lid of claim 10, wherein said central panel has a central portion, and wherein said securing means that comprises part of said gasket is integral with and depends from said central portion.

12. The lid of claim 11, wherein said securing means that comprises part of said gasket includes a trunk that has means for engaging structure of said support.

13. The lid of claim 12, wherein said securing means that comprises part of said support includes means, on said central section of said support, for engaging said engaging means of said gasket.

14. A lip-openable container, comprising:

a container body for containing liquids and having an open top end;

a removable cap hermetically sealed to said container body about its said open top end, said cap having a depending skirt with a ledge that extends radially inward from said skirt, forms a valve seat and defines a central opening; and a removable lip-openable lid for sealing said central opening of said cap, said lid comprising a gasket having an upstanding, lip-engageable wall, said wall being disposed within said central opening and extending upward beyond said ledge, a flexible central panel radially inward of and communicating with said wall, said central panel being comprised of a flexible elastomer and having an integral flexible member that depends from said central panel, and a peripheral flange extending outward from said wall and having an upper surface, and a rigid support that supports said central panel of said gasket and maintains said flange in normal sealing engagement with said valve seat, said rigid support comprising a base, a central section, and liquid flow openings extending through said support, said base being maintained in position by being in contact with a surface of said container or said cap, said central panel of said gasket and said central section of said support each having securing means that are engaged with each other and flexibly secure said gasket to said support, said central panel of said gasket being capable of flexing and stretching downwardly in an area radially inward of said rigid annular wall of said gasket to allow a portion of said upper surface of said flange to be displaced from said valve seat when lip pressure is applied against an adjacent portion of said wall of said gasket.

15. The container of claim 14, wherein said central section of said support has a rigid bearing surface positioned under said central panel of said gasket, such that when said downward pressure is applied against said wall, an adjacent portion of said central panel of said gasket contacts said bearing surface and flexes downward about a portion of said bearing surface to displace said flange from said valve seat.

16. The container of claim 14, wherein said central section of said support has a rigid bearing surface positioned under said central panel of said gasket, such that when said downward pressure is applied against said wall, an adjacent portion of said central panel of said gasket contacts said bearing surface and stretches downward from said bearing surface to displace said flange from said valve seat.

17. The container of claim 14, wherein, when said downward pressure is applied against said wall, said central panel of said gasket contacts said rigid support and is stretched downward over said rigid support to displace said flange from said valve seat.

18. The container of claim 14, wherein said securing means of said support includes upstanding rigid structure with openings therethrough and said securing means of said gasket includes portions of said central panel of said gasket that extend through said openings and engage said rigid structure.

19. The container of claim 14, wherein said wall of said gasket is annular.

20. The container of claim 14, wherein said central panel has a central portion, and wherein said flexible member that depends from said central portion comprises a trunk that includes said securing means of said gasket.

21. The container of claim 20, wherein said central portion of said gasket has an undersurface and said trunk has a neck with an annular radially inwardly concavely curved surface extending between said undersurface and said securing means.

22. The container of claim 21, wherein said securing means of said trunk includes retaining means disposed about said trunk for engaging structure of said support.

23. The container of claim 22, wherein said securing means of said central section of said support includes a hub with engaging means that engages said retaining means of said trunk and flexibly secures said gasket to said support.

24. The container of claim 23, wherein said hub includes an annular convex arcuate bearing surface that engages said concavely curved surface of said trunk and facilitates flexing of said central panel downward and radially outward of said annular bead.

25. The container of claim 23, wherein said trunk of said gasket has a dead end bore extending upward into said trunk, and said lid includes a rigid plug having a stem that is seated inside said bore of said trunk, said stem having a diameter that is greater than the diameter of said bore, such that said stem compresses said trunk against said hub and improves the engagement of said retaining means of said gasket to said support.

26. The container of claim 14, wherein said wall of said gasket is rigid.

27. The container of claim 26, wherein said rigid wall of said gasket is annular and has a lower portion with a radially inwardly extending lip to which said flexible central panel of said gasket is attached.

28. The container of claim 26, wherein said rigid wall of said gasket is annular and has a lower portion with a radially outwardly extending lip, said lip having a layer of an elastomer thereon and forming a portion of said upper surface of said flange.

29. The container of claim 28, wherein said layer of elastomer on said upper surface of said flange has an upstanding peripheral annular sealing bead thereon.

30. A lid for use in connection with a container or container cap having an inwardly extending ledge that forms a valve seat and defines an opening for egress of container contents therethrough, the lid comprising:

a gasket having a diameter that is larger than the opening, and having a central panel that is comprised of a flexible elastomer, and a flange that is engageable with the valve seat; and a support that supports said central panel of said gasket, said support being sustainable by a surface of the container or container cap and, when so sustained, said support positioning said gasket directly against the valve seat of the cap;

wherein said central panel of said gasket is capable of flexing and stretching to allow a portion of said flange to be displaced from the valve seat when downward pressure is applied against a portion of said gasket.

* * * * *